US011623132B2

(12) United States Patent
Dull

(10) Patent No.: US 11,623,132 B2
(45) Date of Patent: Apr. 11, 2023

(54) GAME BOARD AND METHODS AND SYSTEMS FOR PROVIDING AN ENTERTAINING EXPERIENCE OF WAR BETWEEN THE PLAYERS OVER A PLURALITY OF AREAS OF A GAME BOARD

(71) Applicant: Robert Franklin Dull, Vero Beach, FL (US)

(72) Inventor: Robert Franklin Dull, Vero Beach, FL (US)

( * ) Notice: Subject to any disclaimer, the term of this patent is extended or adjusted under 35 U.S.C. 154(b) by 242 days.

(21) Appl. No.: 17/097,247

(22) Filed: Nov. 13, 2020

(65) Prior Publication Data

US 2021/0154565 A1 May 27, 2021

Related U.S. Application Data

(60) Provisional application No. 62/938,826, filed on Nov. 21, 2019.

(51) Int. Cl.

| | |
|---|---|
| ***A63F 1/04*** | (2006.01) |
| ***A63F 3/04*** | (2006.01) |
| ***A63F 3/00*** | (2006.01) |

(52) U.S. Cl.

CPC ..... *A63F 1/04* (2013.01); *A63F 3/00075* (2013.01); *A63F 3/04* (2013.01); *A63F 2003/0439* (2013.01)

(58) Field of Classification Search

CPC ..... A63F 1/04; A63F 3/04; A63F 3/00075; A63F 2003/00078

See application file for complete search history.

(56) References Cited

U.S. PATENT DOCUMENTS

| | | | | |
|---|---|---|---|---|
| 5,476,264 | A * | 12/1995 | Ortega | A63F 3/00075 273/287 |
| 2015/0196832 | A1* | 7/2015 | Schroeder | A63F 1/04 273/308 |
| 2017/0095728 | A1* | 4/2017 | Alindogan | A63F 3/00697 |

* cited by examiner

*Primary Examiner* — Omkar A Deodhar

(74) *Attorney, Agent, or Firm* — Derek Fahey, Esq.; The Plus IP Firm, PLLC

(57) ABSTRACT

Disclosed is a system and method for providing an entertaining experience of war between players over a plurality of areas of a game board. The game board includes a plurality of areas, which may be depicted as a world map, a plurality of board playing cards, and connectors, where the connector makes adjacent a first board playing card of a first playing area with a second board playing card of a second playing area. Each player is delt a plurality of holding cards including the suit assigned to that specific player. The objective of the game is for players to alternate swap requests, swapping holding cards with board playing cards until a player accumulates a winning hand including a straight flush. The defined areas and connectors on the game board increases the interaction and frequency of battles between players making it more difficult to accumulate a winning hand.

20 Claims, 35 Drawing Sheets

700

700

700

GAME BOARD AND METHODS AND SYSTEMS FOR PROVIDING AN ENTERTAINING EXPERIENCE OF WAR BETWEEN THE PLAYERS OVER A PLURALITY OF AREAS OF A GAME BOARD

CROSS-REFERENCE TO RELATED APPLICATIONS

This application claims the benefit of the filing date of U.S. Provisional Application Ser. No. 62/938,826 titled "COMMANDER POKER" and filed Nov. 21, 2019 and the subject matter of which is incorporated herein by reference.

STATEMENT REGARDING FEDERALLY SPONSORED RESEARCH OR DEVELOPMENT

Not applicable.

INCORPORATION BY REFERENCE OF MATERIAL SUBMITTED ON A COMPACT DISC

Not applicable.

TECHNICAL FIELD

The present disclosure relates to the field of playing cards, and more specifically to the field of strategic game boards for playing cards.

BACKGROUND

Blackjack, Mini-Baccarat, Pai Gow Poker, Three Card Poker, Texas Hold'em Bonus Poker, Casino War and Let it Ride are the most popular table games at a casino. Other popular casino games such as Roulette, Craps, and slot machines are easy to play and highly reliant on chance and randomized probabilities. All over the world, people travel to casinos to play games for an entertaining experience. Table games, typically card games, remain among the most popular gaming experiences because the card games allow players to get involved with the action of the game and incorporate knowledge and strategy to try to win.

Poker is the undisputed most popular card game of the world. On its surface, beginner players may believe that poker relies solely on chance and the randomized probability that a player will be delt a strong hand and good river cards. Although true to an extent, a good poker player possesses certain skills. Skills necessary to be a successful poker player include the ability to develop a strategy, read the body language of opposing players, have patience and discipline, and knows how to maintain an unpredictable playing style. A good poker player will observe opposing players and keep a mental note of what actions on the table trigger a response in the opposing player. For example, important information to be aware of when playing poker includes pot size, when a player folds, bluffs, checks the river, calls an opposing player, raises the bet, or goes all in.

Since the 1950's economic and mathematic theory has been applied to the interaction between people to determine predictive models of behavior and outcomes of probability. This economic and mathematical theory, now called Game Theory, provides the principle that the best result comes from everyone in a group doing what is best for themselves and what is best for the group. Over the years, Game theory has developed analytical models for real world behavior ranging anywhere between interrogation techniques to economic competition to simple behavioral outcomes players choose when faced with a dilemma. Applicable to table card games, when players are faced with a choice, mathematical theory suggests optimal decisions. In poker, a player may make optimal decisions based on the risk to bet wager ratio; thus, observation of a player's behavior will determine the optimal solution of whether a player is likely to fold, have a good hand, or bluff his or her way to victory. Or in card games that provide for player to player interaction, players may decide to choose a path to victory that avoids conflict and decision making.

The uncertainty, risk, strategy, and player behavior provide the adrenaline rush and entertaining experience that players crave. Players are always looking for new games to challenge themselves, strategize, and interact with other players.

As a result, there exists a need for improvements over the prior art and more particularly for a better way to provide players with a strategic game board to increase player interaction and enhance the overall card game playing experience.

SUMMARY

A system and method for providing an entertaining experience of war between the players over a plurality of areas of a game board is disclosed. This Summary is provided to introduce a selection of disclosed concepts in a simplified form that are further described below in the Detailed Description including the drawings provided. This Summary is neither intended to identify key features or essential features of the claimed subject matter, nor is this Summary intended to be used to limit the claimed subject matter's scope.

In one embodiment, a method for providing an entertaining experience of war between the players over a plurality of areas of a game board is disclosed. The method comprises using a game board defined by a plurality of areas defined by playing cards from a deck of cards, wherein the object of the game is to accumulate a straight flush on one of the plurality of areas or in a player's hand, where the method includes dealing a first player a plurality of first player holding cards that are all a first suit of a deck of playing cards, where only the first suit is assigned to the first player. Once the first player is delt, dealing a second player a plurality of second player holding cards that are all a second suit of the deck, where only the second suit is assigned to the second player. After dealing the first player and second player, displaying the game board to the first player and second player, the game board including a plurality of board playing cards from the deck of playing cards, and where the plurality of board playing cards displayed on the game board define the plurality of areas. The method of playing the game involves receiving a swap request from a requesting player, where the requesting player is one of the first player and the second player, to swap a selected holding card from one of a requesting player's holding cards with a selected board playing card of one of the plurality of board playing cards. After receiving the swap request, swapping the selected holding card with the selected board playing card if the selected board playing card is an uncontrolled card and is adjacent to a requesting player's controlled card, where the uncontrolled card comprises a third suit and where the requesting player's controlled card comprises the suit assigned to the requesting player. If the selected board playing card is an opposing player's controlled card, where the opposing player is one of the first player and second player that is not the requesting player, and adjacent to the requesting player's controlled card, then having displayed both a first battle card of the requesting player and a second battle card of the opposing player where the first battle card is randomly selected from the requesting player's holding cards and the second battle card is randomly selected from an opposing player's holding cards. After the first battle card of the requesting player and the second battle card of the opposing player are displayed, determining that the requesting player is a battle winner if the first battle card of the requesting player card has a ranking greater than the second battle card of the opposing player. After determining that the requesting player is the battle winner, replacing the selected board playing card with the selected holding card of the requesting player, adding the selected board playing card to the opposing player's holding cards; adding the first battle card of the requesting player to the requesting player's holding cards and adding the second battle card of from the opposing player to the opposing player's holding cards. Alternatively, after the first battle card of the requesting player and the second battle card of the opposing player are displayed, determining the requesting player is a battle loser if the second battle card of the opposing player has the ranking greater than the first battle card of the requesting player. After determining that the requesting player is a battle loser, not replacing the selected board playing card with the selected holding card, adding the first battle card of the requesting player to the requesting player's holding cards, and adding the second battle card of the opposing player to the opposing player's holding cards. The first player and second player alternate turns each becoming the requesting player for sending swap requests until one of the first player and second player accumulates a straight flush to win the card game.

Additional aspects of the disclosed embodiment will be set forth in part in the description which follows, and in part will be obvious from the description, or may be learned by practice of the disclosed embodiments. The aspects of the disclosed embodiments will be realized and attained by means of the elements and combinations particularly pointed out in the appended claims. It is to be understood that both the foregoing general description and the following detailed description are exemplary and explanatory only and are not restrictive of the disclosed embodiments, as claimed.

BRIEF DESCRIPTION OF THE DRAWINGS

The accompanying drawings, which are incorporated in and constitute part of this specification, illustrate embodiments of the disclosure and together with the description, serve to explain the principles of the disclosed embodiments. The embodiments illustrated herein are presently preferred, it being understood, however, that the disclosure is not limited to the precise arrangements and instrumentalities shown, wherein.

DETAILED DESCRIPTION

Figure 1:
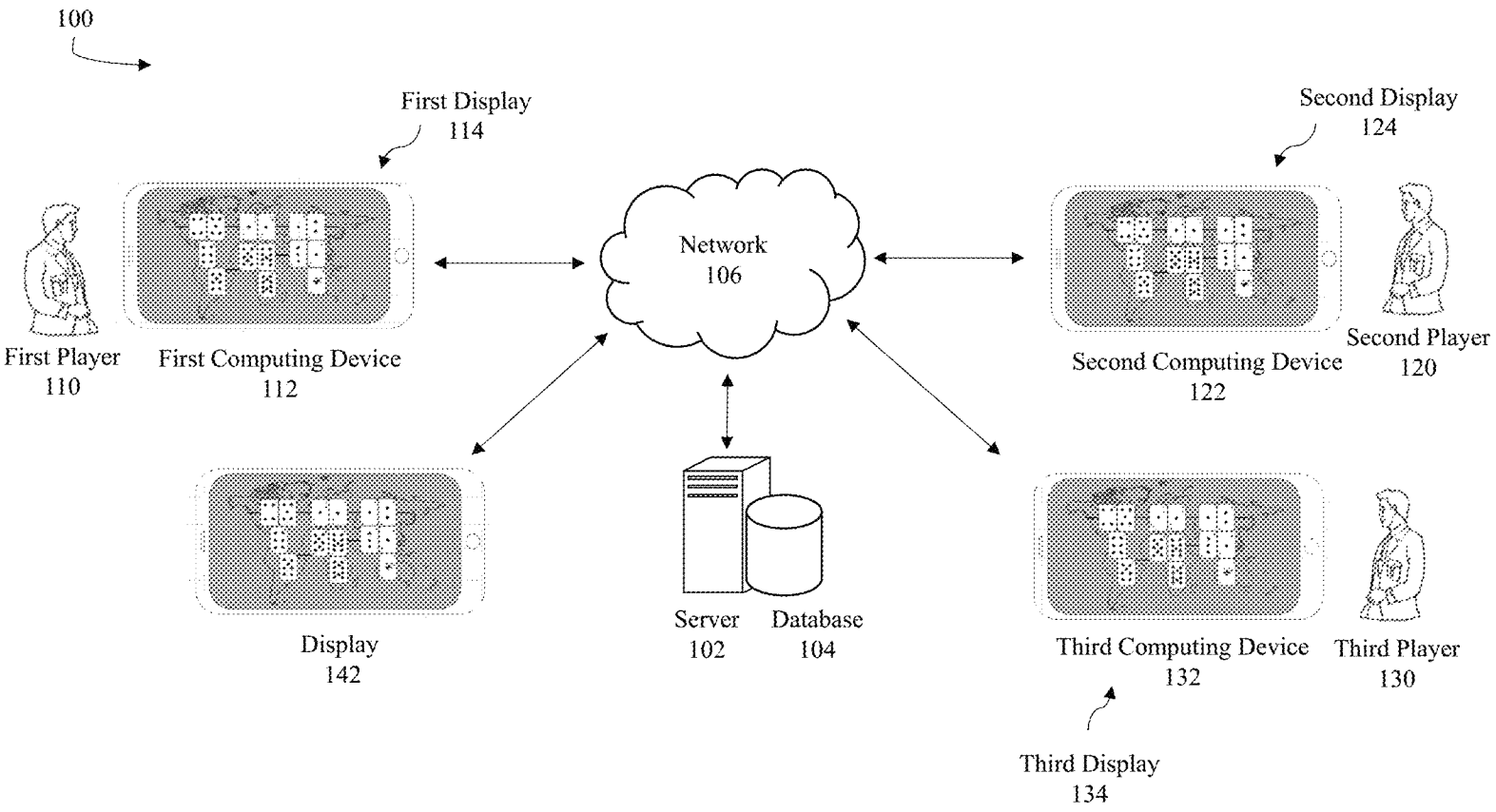
FIG. 1 is a diagram illustrating an operating environment that supports a system for providing an entertaining experience of war between the players over a plurality of areas of a game board over a communications network, according to an example embodiment.

The following detailed description refers to the accompanying drawings. Whenever possible, the same reference numbers are used in the drawings and the following description to refer to the same or similar elements. While disclosed embodiments may be described, modifications, adaptations, and other implementations are possible. For example, substitutions, additions or modifications may be made to the elements illustrated in the drawings, and the methods described herein may be modified by substituting reordering or adding additional stages or components to the disclosed methods and devices. Accordingly, the following detailed description does not limit the disclosed embodiments. Instead, the proper scope of the disclosed embodiments is defined by the appended claims.

The disclosed embodiments improve upon the problems with the prior art by providing a system and method for providing an entertaining experience of war between the players over a plurality of areas of a game board. The present disclosure improves over the prior art by providing the game board having a plurality of areas. The plurality of areas on the game board are defined for displaying a plurality of board playing cards. Within the each of the plurality of areas, connectors on the game board connect a first board playing card of the plurality of board playing cards in a first area of the plurality of areas with a second board playing card of the plurality of board playing cards in a second area of the plurality of areas. The connecter makes the first board playing card and the second board playing card adjacent. Players, including a first player and a second player, alternate sending swap requests to the game board. The swap request includes swapping selected board playing card of the plurality of board playing cards with the selected holding card of the requesting player's holding cards. The selected board playing card must be adjacent to a controlled card of the requesting player. The configuration of the game board including the plurality of areas and connectors increases the interactions between the first player and second player, specifically, increasing the frequency of battles between players as each of the first player and second player alternate swap requests until one of the first player and second player accumulates a winning hand.

Referring now to the Figures, FIG. 1 is a diagram illustrating an operating environment 100 that supports a system for providing an entertaining experience of war between the players over a plurality of areas of a game board over a communications network 106, according to an example embodiment. The environment 100 may include first computing device 112 and a second computing device 122, which may communicate with server 102 via a communications network 106. In the example embodiment disclosed in FIG. 1, the environment may also include a third computing device 132 and a display 142 which may communicate with server 102 via a communications network 106. First computing device 112, second computing device 122, third computing device 132 may include cellular telephones, smart phones, handheld computers, laptop computers or tablet computers, mobile computing devices, remote computing devices, and each of the first computing device 112, second computing device 122, third computing device 132, and display 142 may be operated at least one of the first player 110, second player 120, third player 130.

As shown in FIG. 1, display 142 is shown as an independent entity. In one embodiment, display device may include at least one of first computing device, second computing device, and third computing device. Display may include cellular telephones, smart phones, handheld computers, laptop computers or tablet computers, mobile computing devices, remote computing devices, display screens, touch screen displays, televisions, monitors, and any other devices that are capable of outputting a visual display. Each of the first computing device 112, second computing device 122, and third computing device 132, may define display 142. As shown in FIG. 1, each of the first computing device, second computing device, third computing device, and display, includes a display of the system of the present disclosure. For example, FIG. 1 shows the first computing device including a first display 114, the second computing device including a second display 124, and the third computing device including a third display 134. In an example embodiment, display 142 may display a game board 500 of FIG. 5A and FIG. 5B, the first display may also display a plurality of first player holding cards 1010 of FIG. 10, and the second display may also display the plurality of second player holding cards 1020 of FIG. 10.

First computing device, second computing device, third computing device, and display may also include other computing devices such as desktop computers, workstations, and game consoles, for example. The first computing device, second computing device, third computing device, and display may be connected either wirelessly or in a wired or fiber optic form to the communications network 106. Communications network 106 may be a packet switched network, such as the Internet, or any local area network, wide area network, enterprise private network, cellular network, phone network, mobile communications network, or any other combination of the above. Communications network 106 may also include a decentralized network, such as blockchain, or distributed ledger technology, for example.

Server 102 may be an application server or a web server that includes a software engine that includes a software engine that delivers applications, data, program code and other information to networked devices such as first computing device 112, second computing device 122, third computing device 132, and display 142. The software engine of server 102 may perform other processes such as transferring data in a stream of packets that are interpreted and rendered by a software application as the data packets arrive. FIG. 1 further shows that server 102 includes a database or repository 104, which may be a relational database comprising a Structured Query Language (SQL) database stored in a SQL server. First computing device 112, second computing device 122, third computing device 132, and dealer computing device 142 may also include databases. The database 104 may serve data related to a dealing a first player a plurality of first player's holding cards (step 704 in FIG. 7A), dealing a second player a plurality of second player's holding cards (step 706 in FIG. 7A), displaying a game board (step 708 in FIG. 7A), as well as data related to executing the method 700 of FIGS. 7A, 7B, 7C, 7D, 7E, and 7F, as well as related information, used by server 102 and first computing device, second computing device, third computing device, and display during the course of operation of this disclosure. Server is capable of displaying the game board (step 708 of FIG. 7) on at least one of the first computing device, second computing device, third computing device, and display. Note that in FIG. 1, the server 102 is shown as a single and independent entity, in one embodiment, server and its functionality can be realized in a centralized fashion in one computer system, or in a distributed fashion wherein different elements are spread across several interconnected computing systems.

Server and first computing device, second computing device, third computing device, and display may each include program logic or computer program code including computer source code, scripting language code, or interpreted language code that perform various functions of the present invention. In one embodiment, the aforementioned program logic may include program module 1907 in FIG. 19. It should be noted that although FIG. 1 shows four computing devices including first computing device 112, second computing device 122, third computing device 132, and display computing device 142, and one server 102, the system of the present disclosure supports any number of servers and computing devices connected via communications network 106.

Figure 2:
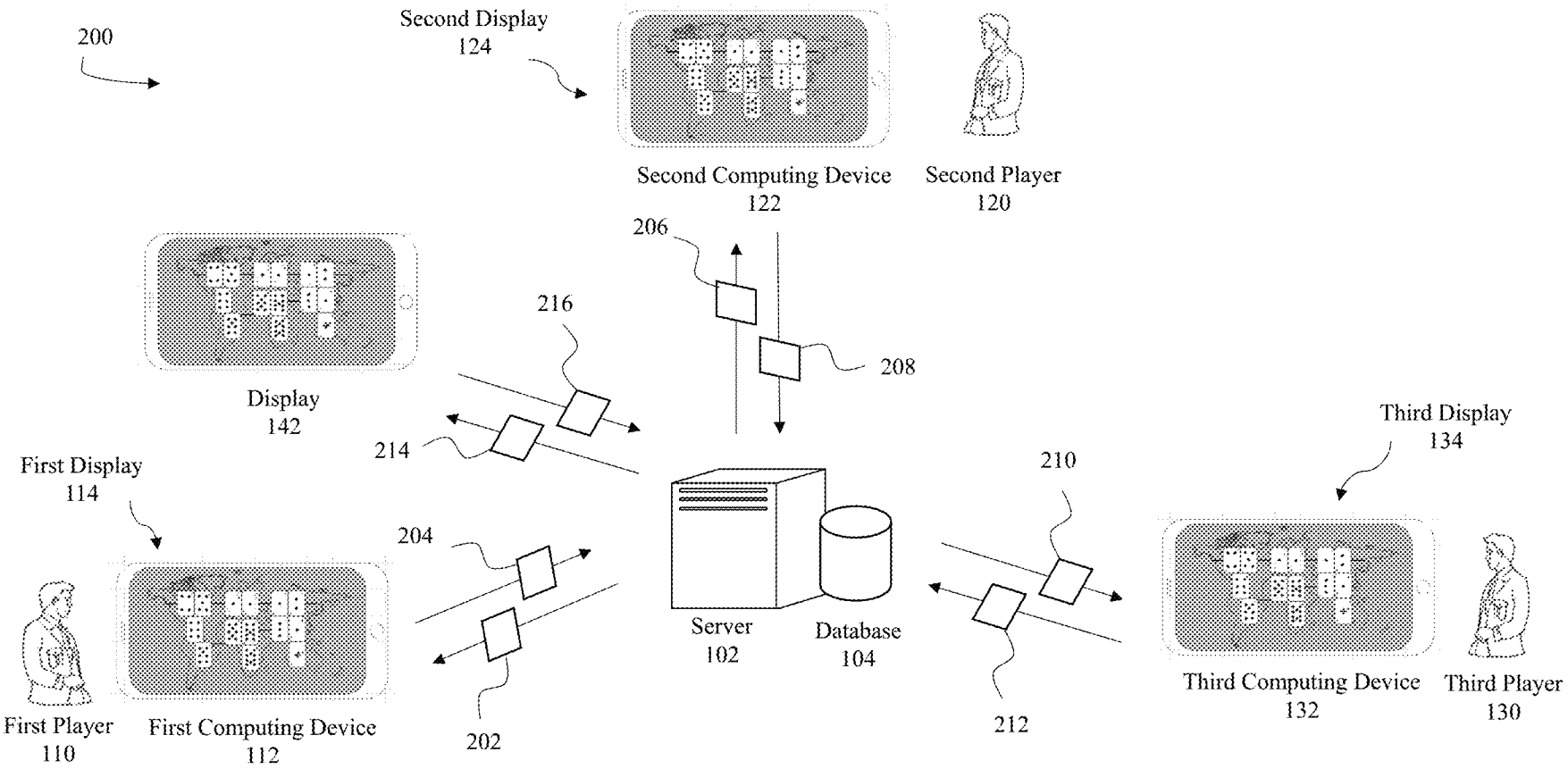
FIG. 2 a diagram illustrating data flow of information exchanged in an operating environment that supports a system for providing an entertaining experience of war between the players over a plurality of areas of a game board over a communications network according to an example embodiment.

FIG. 2 is a diagram illustrating data flow 200 of information exchanged in operating environment 100 that supports a system for providing an entertaining experience of war between the players over a plurality of areas of a game board over a communications network 106, according to an example embodiment. Note that FIG. 2 is in reference to FIG. 1. The server 102 including at least one processor configured for transmitting information or information packets or data packets 202, 206, 210, and 214 and receiving information or information packets or data packets 204, 208, 212, and 216.

Figure 9:
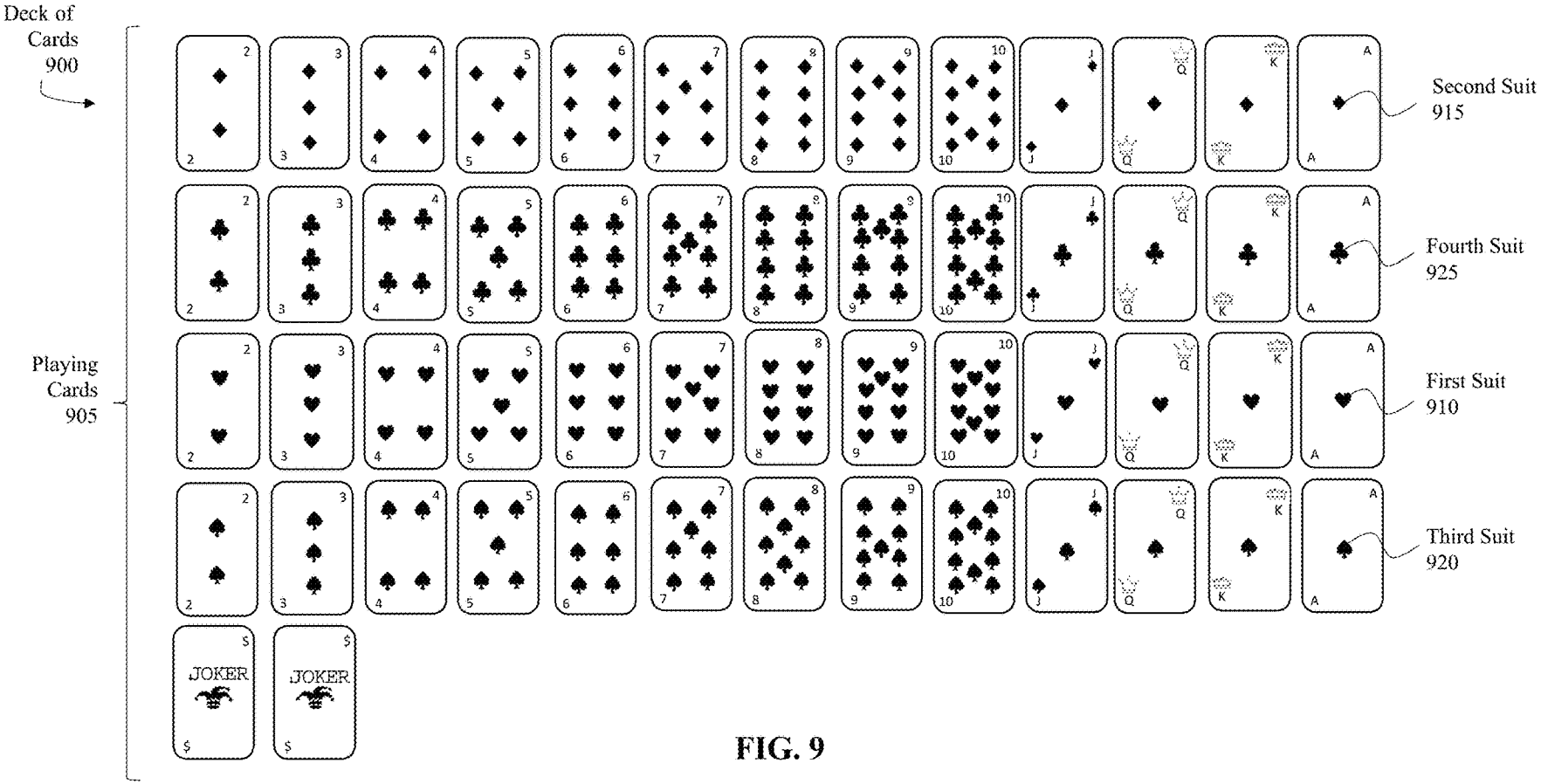
FIG. 9 illustrates a deck of cards, according to an example embodiment.

Transmitting information is data transmitted by the processor to at least one of the first computing device 112 and the second computing device 122. As shown in FIG. 2, in an example embodiment, the transmitting information is transmitted by the server 102, including a processor, to the first computing device 112, the second computing device 122, and the third computing device 132. The transmitting information may also transmit data between the server and the first display 114, the second display 124, the third display 134, and the display 142. The transmitting information may correspond to a plurality of first player holding cards 1010 detailed in FIG. 10 which are all a first suit 910 of a deck of playing cards 900 detailed FIG. 9, where only the first suit 915 of FIG. 9 is assigned to the first player 110, and where the first computing device 112 includes a first display 114 and where the second computing device 122 includes a second display 124. The transmitted information may correspond to a plurality of second player holding cards 1020 of FIG. 10, where the second player holding cards are all a second suit 915 of FIG. 9 of the deck of playing cards, where only the second suit is assigned to the second player 120. However, it is understood that in certain embodiments and during the game, other types of suits may also be use and are within the spirit and scope of the present invention. The transmitted information may correspond to a plurality of board playing cards 650 of FIG. 6 from the deck of playing cards defining a plurality of areas (exampled by 450 of FIG. 4A) to be displayed on at least one of a first display 114 and a second display 124.

The receiving information 204, 208, 212, and 216 is data received by the server 102 via at least one of the first computing device 112 and second computing device 122. As shown in FIG. 2, in an example embodiment, the receiving information is received by the server via the first computing device, second computing device, and third computing device 132. The receiving information may also be received by the server 102 via the first display 114, second display 124, third display 134, and display 142. The receiving information may be information corresponding to a receiving a swap request (step 724 of method 700 of FIG. 7C; exampled by 1140 of FIG. 11B) from the requesting player, to swap a selected holding card (step 730 of method 700 of FIG. 7C) from one of a requesting player's holding cards (exampled by 1100 of FIG. 11A) with a selected board playing card (exampled by 1130 of FIG. 11B) of one of the plurality of board playing cards.

Figure 3:
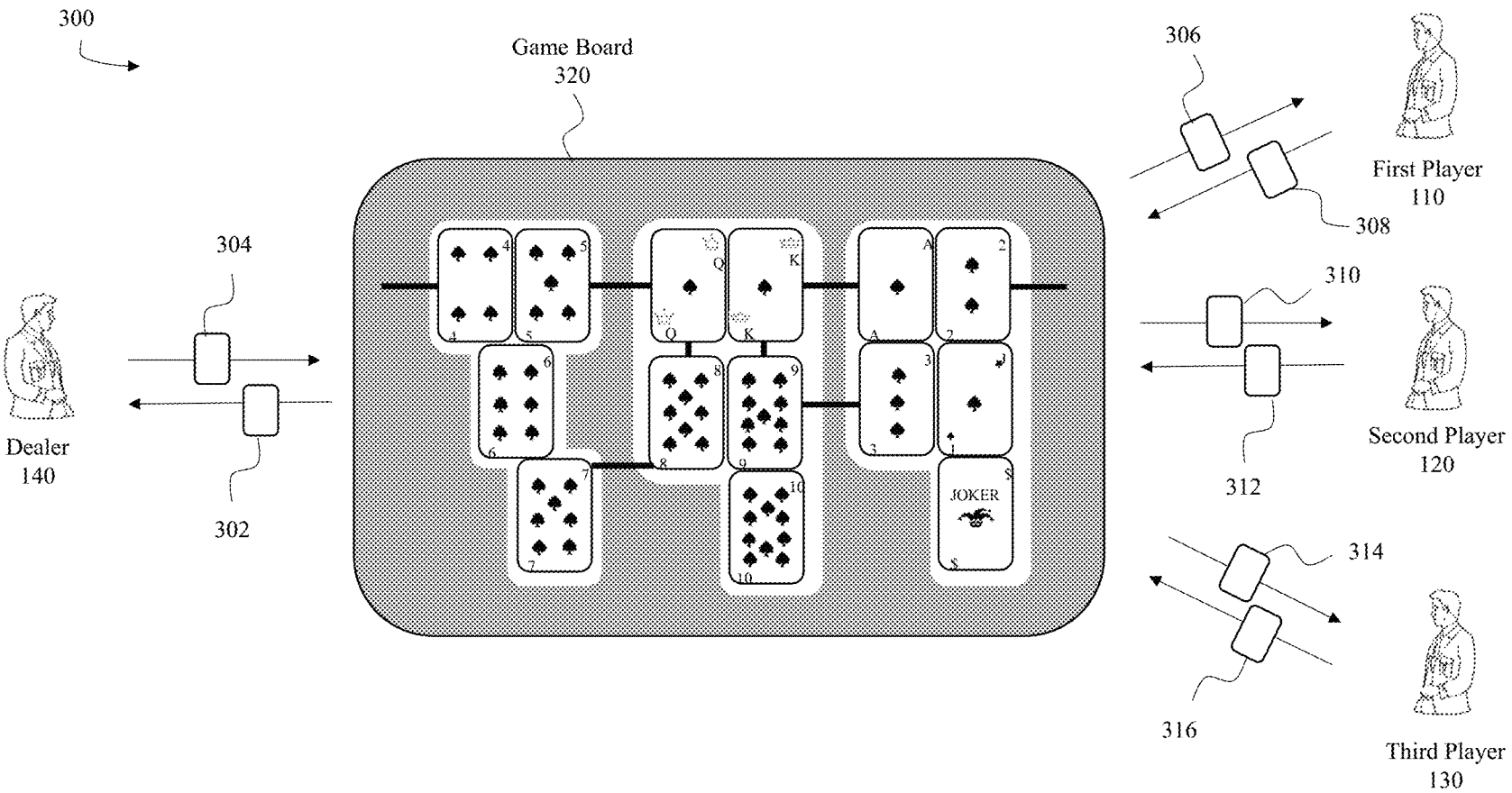
FIG. 3 is a diagram of a physical environment that supports a system for providing an entertaining experience of war between the players over a plurality of areas of a game board, according to an example embodiment.

FIG. 3 is a diagram 300 of a physical environment that supports a system 100 for providing an entertaining experience of war between the players over a plurality of areas 450 of a game board 400 (detailed in FIG. 4A), according to an example embodiment. Note that FIG. 3 is a physical diagram of the system 100 and FIG. 2 is a diagram of the data transmitting and receiving by the server 102 of system 100. The diagram 300 includes a game board (400 of FIG. 4A) wherein the game board transmits a selected board playing card (exampled by 1130 of FIG. 11B) from a plurality of board playing cards (exampled by 650 of FIG. 6) to at least one of the first player 110 and second player 120. The game board may also receive board playing cards from at least one of the first player 110 and second player 120 including receiving a selected holding card (exampled by 1120 of FIG. 11B), a first battle card (exampled by 1620 of FIG. 16B), and a second battle card (exampled by 1630 of FIG. 16B). As shown in FIG. 3, a dealer 140 may deal cards onto the game board and also to each of the players. The dealer 140 as shown in FIG. 3 is an independent entity. In other embodiments, the dealer may be one of the first player 110, second player 120, and third player 130.

With reference to FIG. 3, illustrates that cards 302, 306, 310, and 314 being sent to the players and cards 304, 308, 312, and 316 sent from the players. The cards being sent to the players may be displayed to only the players or may be displayed to other players as well. The cards being sent from the players may be used for being displayed on the game board or may also be used as a battle card, which will be further explained below.

Figure 4A:
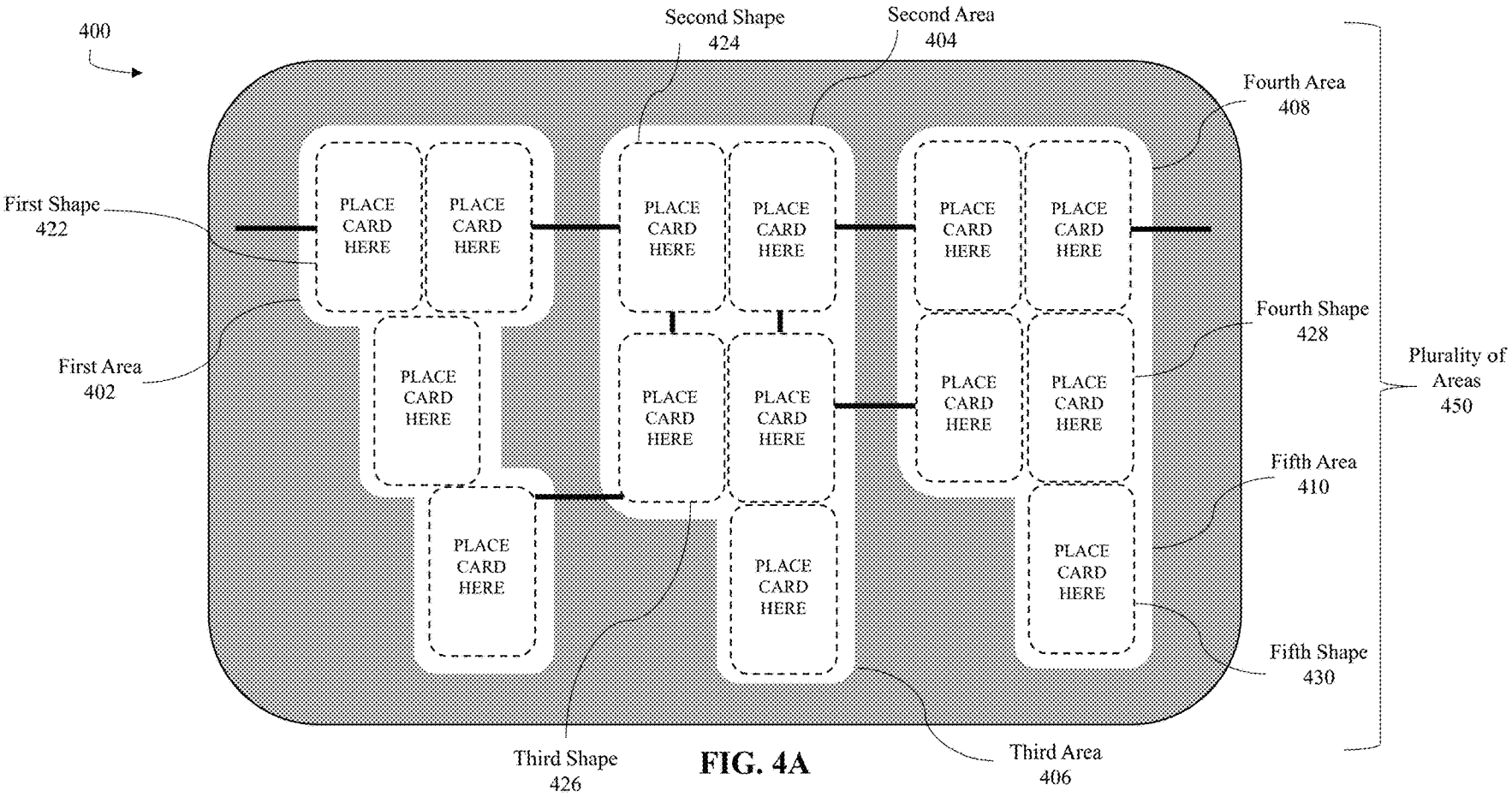
FIG. 4A illustrates the game board game board of the system including a plurality of areas for playing cards, according to an example embodiment.
Figure 4B:
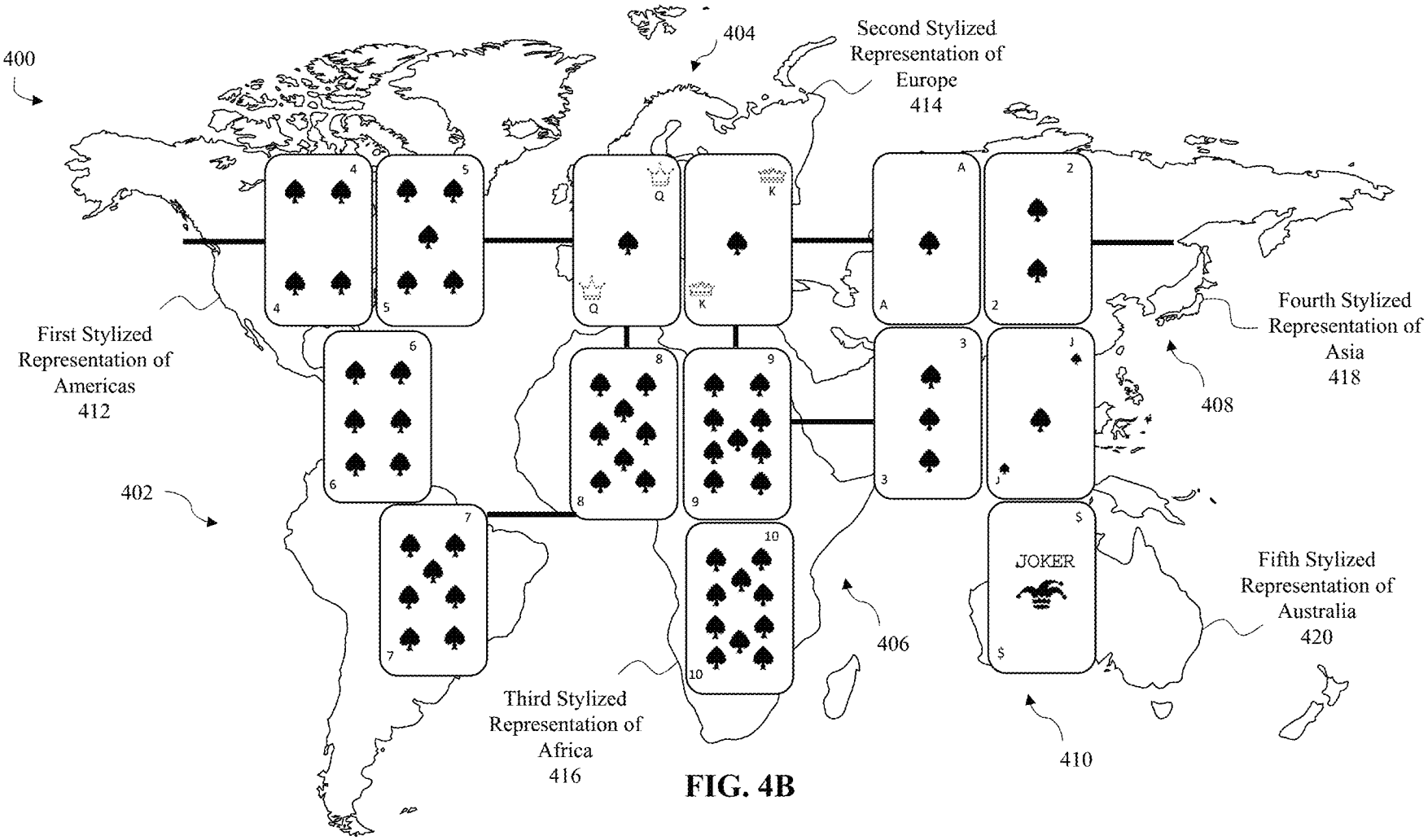
FIG. 4B illustrates a game board of the system including a plurality of areas for playing cards depicted as a world map, according to an example embodiment.
Figure 6:
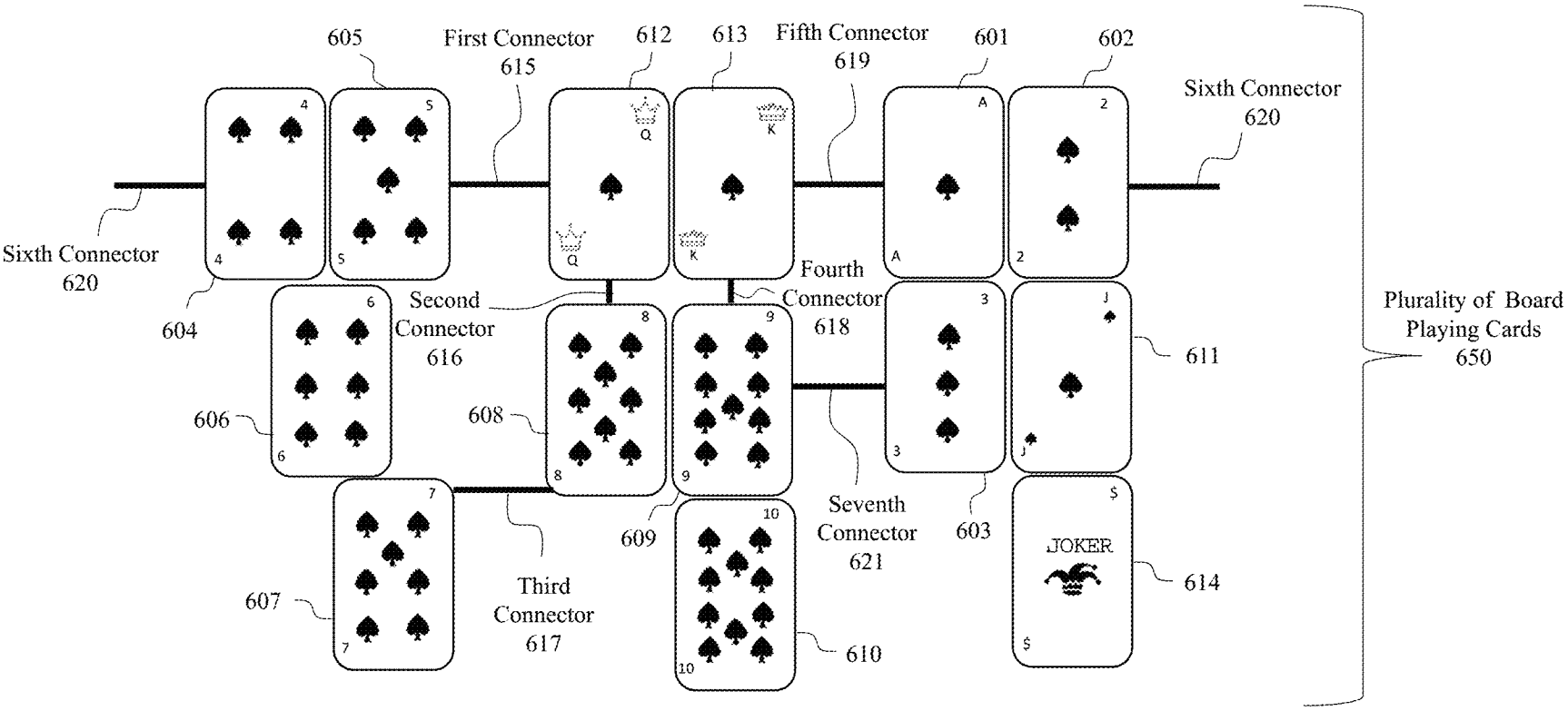
FIG. 6 illustrates the game board of the system having connectors and including a plurality of board playing cards from a deck of playing cards, according to an example embodiment.

Now referring to FIGS. 4A and 4B, FIG. 4A illustrates the game board 400 of the system 100 including a plurality of areas 402, 404, 406, 408, and 410 for playing cards, according to an example embodiment and FIG. 4B illustrates game board 400 of the system 100 including a plurality of areas 402, 404, 406, 408, and 410 for playing cards depicted as a world map, according to an example embodiment. Referring to FIG. 4A, the game board 400 includes a plurality of board playing cards 650 as shown in FIG. 6. The plurality of board playing cards are displayed on the game board 400 defining the plurality of areas 402, 404, 406, 408, and 410.

The plurality of areas 402, 404, 406, 408, and 410 are depicted on the game board to direct at least one of the first player 110 and second player 120 to place the plurality of board playing cards (exampled in FIG. 8) from the deck of cards (exampled in FIG. 9).

Referring to FIG. 4A, the first area 402 includes a first shape 422 defined by four board playing cards from the deck of cards, as illustrated by the dotted lines. A second area 404 includes a second shape 424 defined by two playing cards from the deck of cards. A third area 406 includes a third shape 426 defined by three playing cards from the deck of cards. A fourth area 408 includes a fourth shape 428 defined by four playing cards from the deck or cards. A fifth area 410 includes a fifth shape 430 defined by one playing card of the deck of cards. In one embodiment the plurality of areas may include the plurality of shapes depicted as visual representations of geographical areas. In one embodiment the plurality areas may include the plurality of shapes depicted as in FIG. 4A. In one embodiment the plurality of areas may include the plurality of shapes depicted as topographical representations of areas having representations in three dimensions. For example, the game board may include a plurality of areas that have designated three dimensional areas for the board playing cards and it may also include three dimensional representations of geographical areas and features, such as mountain ranges or canyons.

As illustrated in FIG. 4B, the first area includes the first shape 422 defined by four board playing cards from the deck of cards, where the first shape defines a first stylized representation of Americas 412. The second area 404 includes the second shape 424 defined by two playing cards from the deck of cards, where the second shape defines a second stylized representation of Europe 414. The third area 406 includes the third shape 426 defined by three playing cards from the deck of cards, where the third shape defines a third stylized representation of Africa 416. The fourth area 408 includes the fourth shape 428 defined by four playing cards from the deck or cards, where the fourth shape defined a fourth stylized representation of Asia 418. The fifth area 410 includes the fifth shape 430 defined by one playing card of the deck of cards, where the fifth shape defines a fifth stylized representation of Australia 420.

Figure 5A:
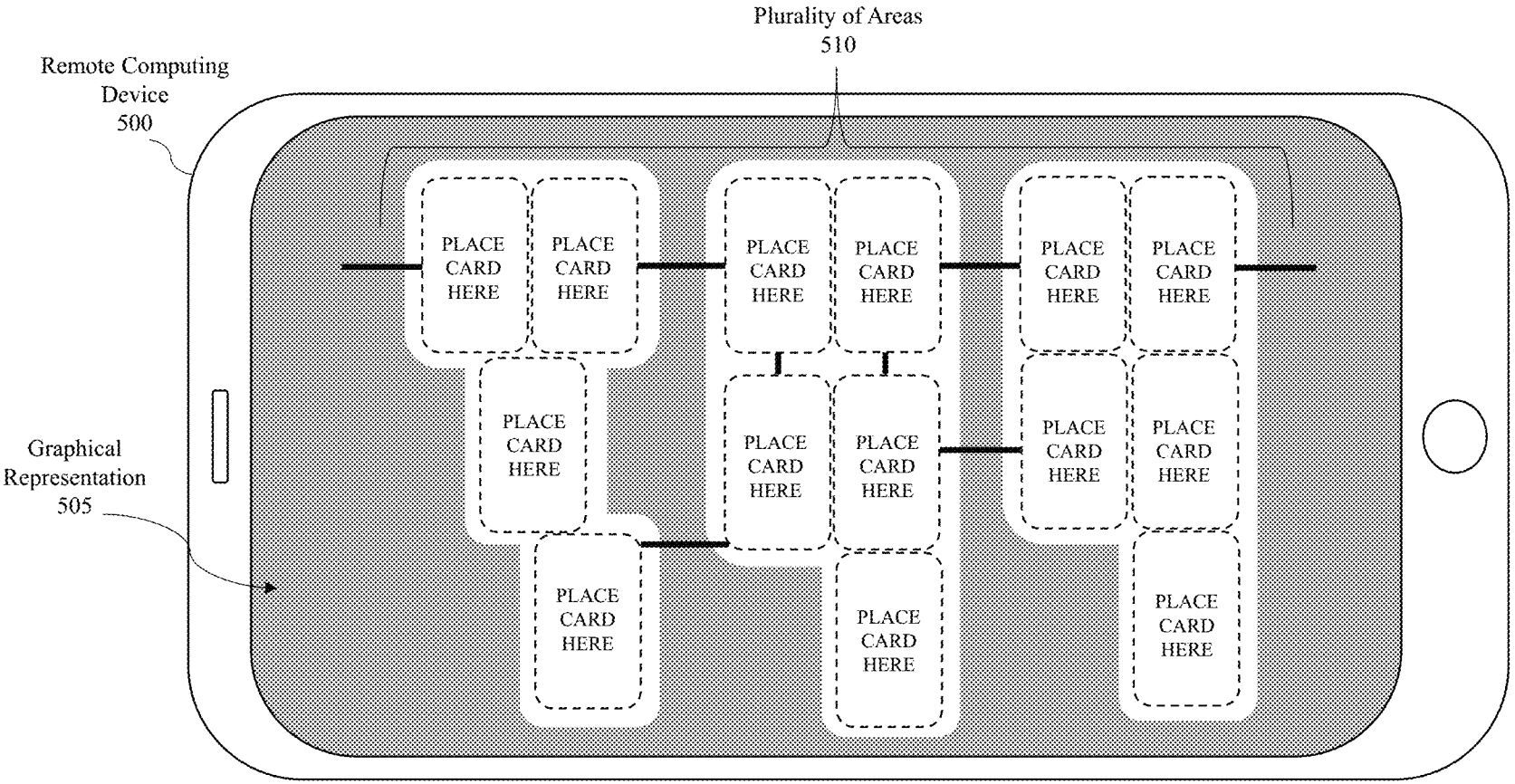
FIG. 5A illustrates the game board of the system including a plurality of areas for playing cards as shown on a remote computing device and a graphical representation, according to an example embodiment.

FIG. 5A illustrates the game board 400 of the system 100 including a plurality of areas 510 for playing cards as shown on a remote computing device 500 and a graphical representation 505, according to an example embodiment. FIG. 5 is an example embodiment of FIG. 4A as depicted on a remote computing device of the system 100 including first computing device 112, second computing device 122, third computing device 132, and display 142. The game board may be displayed on at least one of the first remote computing device, second computing device, third computing device, and display of FIG. 1. The plurality of areas 510 includes at least one of the first area, second area, third area, fourth area, and fifth area shown in FIG. 4A.

Figure 5B:
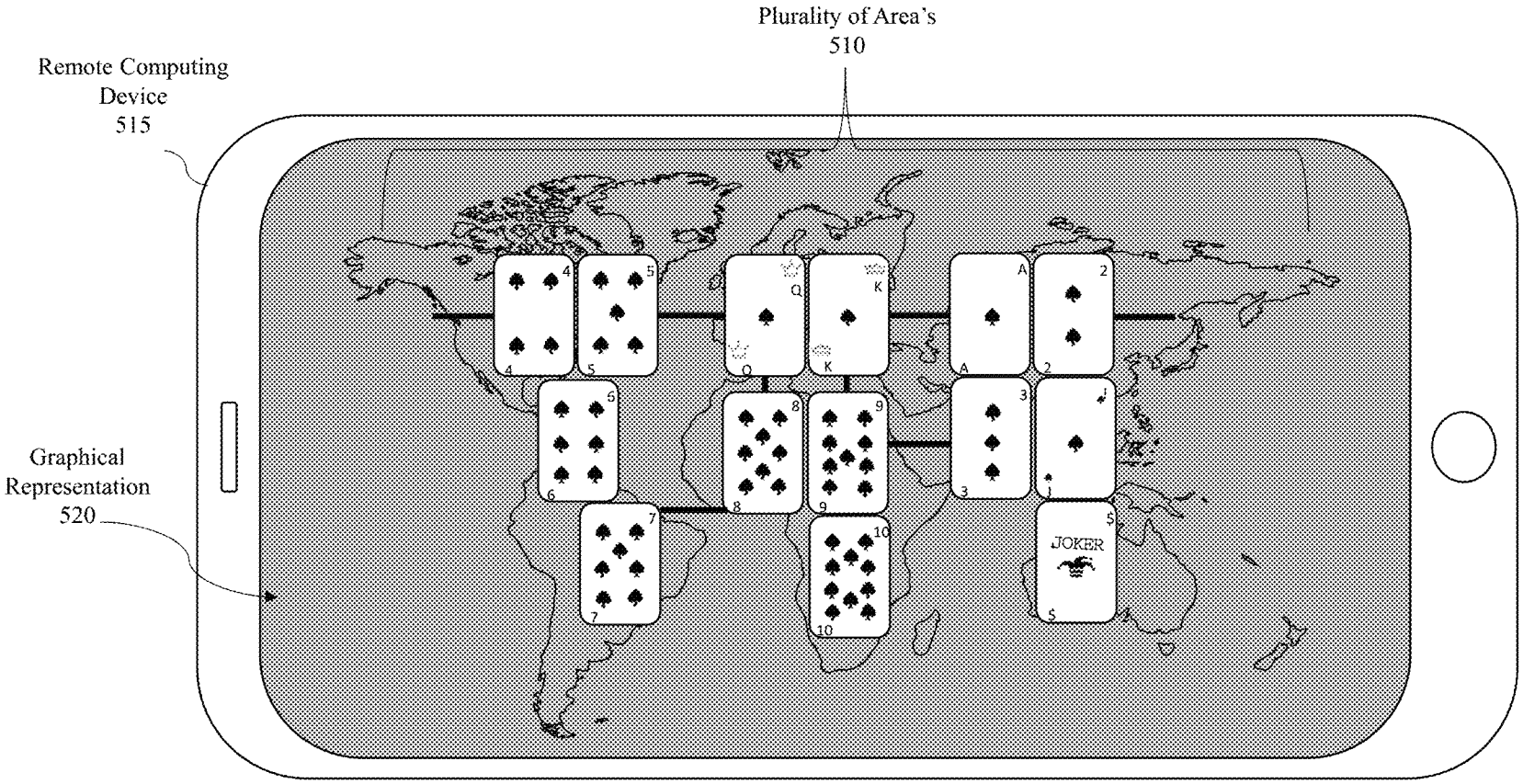
FIG. 5B illustrates the game board of the system including a plurality of areas for playing cards depicted as a world map as shown on a remote computing device and graphical representation, according to an example embodiment.

FIG. 5B illustrates the game board of the system including a plurality of areas for playing cards depicted as a world map as shown on a remote computing device 515 and graphical representation 520, according to an example embodiment. FIG. 5B is an example embodiment of FIG. 4B as depicted on a remote computing device of the system 100 including first computing device 112, second computing device 122, third computing device 132, and display 142. The game board may be displayed on at least one of the first remote computing device, second computing device, third computing device, and display of FIG. 1. The plurality of areas 525 includes at least one of the first stylized representation of Americas, second stylized representation of Europe, third stylized representation of Africa, fourth stylized representation of Asia, and fifth stylized representation of Australia, as shown in FIG. 4A. The graphical representation of the game board also includes the plurality of board playing cards further depicted in FIG. 8.

FIG. 6 illustrates the game board of the system having connectors and including a plurality of board playing cards from a deck of playing cards, according to an example embodiment. The game board 400 including the plurality of areas 402, 404, 406, 408, and 410, as shown in FIGS. 4A-5B, further includes board playing cards. The board playing cards 650 include cards from a deck of cards 900 of FIG. 9. As shown in FIG. 6, the board playing cards may be an ace of spades 601, a two of spades 602, a three of spades 603, a four of spades 604, a five of spades 605, a six of spades 606, a seven of spades 607, an eight of spades 608, a nine of spades 609, a ten of spades 610, a jack of spades 611, a queen of spades 612, a king of spades 613, and a joker 614. The game board having the four board playing cards in the first area 402 are the four of spades adjacent and to the left of the five of spades, the six of spades adjacent and below the four and five of spades, and the seven of spades adjacent and below the six of spades. The two board playing cards in the second area 404 are the queen of spades adjacent and to the left of the king of spades, where the queen of spades is connected by a first connector 615 to the five of spades. The three board playing cards in the third area 406 are the eight of spades adjacent and to the left of the nine of spades and the ten of spades adjacent and below the nine of spades, where the eight of spades is connected by a second connecter 616 to the queen of spades and by a third connector 617 to the seven of spades, and where the nine of spades is connected by a fourth connector 618 to the king of spades. The four board playing cards in the fourth area 408 are the ace of spades adjacent and to the left of the two of spades, the three of spades below and adjacent to the ace of spades, the jack of spades below the two of spades and adjacent to both the three of spades and the two of spades, where a fifth connector 619 connects the king of spades with the ace of spades, a sixth connector 620 connects the two of spades and the four of spades, and a seventh connector connects 621 the three of spades and the nine of spades; and, the one board playing card in the fifth area 410 is a joker adjacent to the jack of spades. As shown in FIG. 6, the joker is directly below the jack of spades. In one embodiment the joker may be oriented to the right of the jack of spades and adjacent. In one embodiment the joker may be connected to the jack of spades via a connector. Additionally, the exact positioning of the cards as explained above an illustrated in FIG. 6 also increases enjoyment to the user as explained below.

The position of each of the plurality of board playing cards of the deck of cards within the shapes creating the stylized representations of the areas depicted as continents of the world map enhances an entertaining experience to the users. According to the example embodiment, the game board having the plurality of areas and a plurality of board playing cards increases the enjoyment of the first player, and second player by increasing interaction between the first and second player. The interaction between the first player and second player increases because the oriented manner of the board playing cards on the game board creating the plurality of areas allows for the first player and second player to engage with each other in more battles over controlled areas when there is a swap request of a board playing card adjacent to the requesting player's controlled card and having the suit assigned to the opposing player. Because the plurality of the board playing cards are positioned having the plurality of areas and oriented in the particular manner, the frequency of battles increases, because one of the first player and second player can accumulate a winning hand only by having controlled cards in at least two of the first area, second area, third area, fourth area, and fifth area.

As positioned on the game board, the four playing cards within the first area are positioned have the stylized representation of the Americas, including North America and South America. The plurality of board playing cards positioned in the first area on the game board may include three connectors connecting the Americas to three different areas of the plurality of areas including the second area, the third area, and the fourth area; therefore, a player having controlled cards in the first area may battle the player having controlled cards in the second area, third area, and fourth area. The queen and king are positioned in the second area which depicts the stylized representation of Europe, where the queen and king generally represent the monarchies of Europe, an in one embodiment the queen may represents the Queen of England and the king may represents the King of the Netherlands, Belgium, Spain, Norway, and Sweden. The second area may be connected via connectors to the first area, third area, and fourth area. The three board playing cards oriented in the manner depicted in FIG. 6 of the third area has the shape of Africa including the stylized representation of Africa. The fourth area may be connected via connectors to the first area, second area, and fourth area. The four board playing cards in the fourth area have the shape of Asia including the stylized representation of Asia. The fourth area may include connectors connecting the fourth area to the second area, the third area, the fourth area, and fifth area. The fifth area, including the joker having the shape of Australia including the stylized representation of Australia. The fifth area is only connected to the Asia, the fourth area. In one embodiment, one of the first player and second player must control all of the four board playing cards having the stylized representation of Asia. After one of the first player and second player control the fourth area by having controlled cards representing the board playing cards of the ace of spades, the two of spades, the three of spades, and the jack of spades, then the respective player that controls the fourth area can control the joker on the that player's next turn by adding the joker to the plurality of holding cards. In one embodiment the player controlling the fourth area can add the joker to the plurality of holding cards during the concurrent turn where the player having the fourth controlled card of the fourth area. In one embodiment, the player may use the joker as a wild card, where the player may replace any board playing card with the holding card representing the joker. The joker can include the ranking of any of the plurality of cards of the deck of cards. The joker may be swapped with any selected board playing card if the selected board playing card is adjacent to the controlled card of the requesting player and regardless of whether the selected board playing card has the suit assigned to the opposing player.

Figure 8:
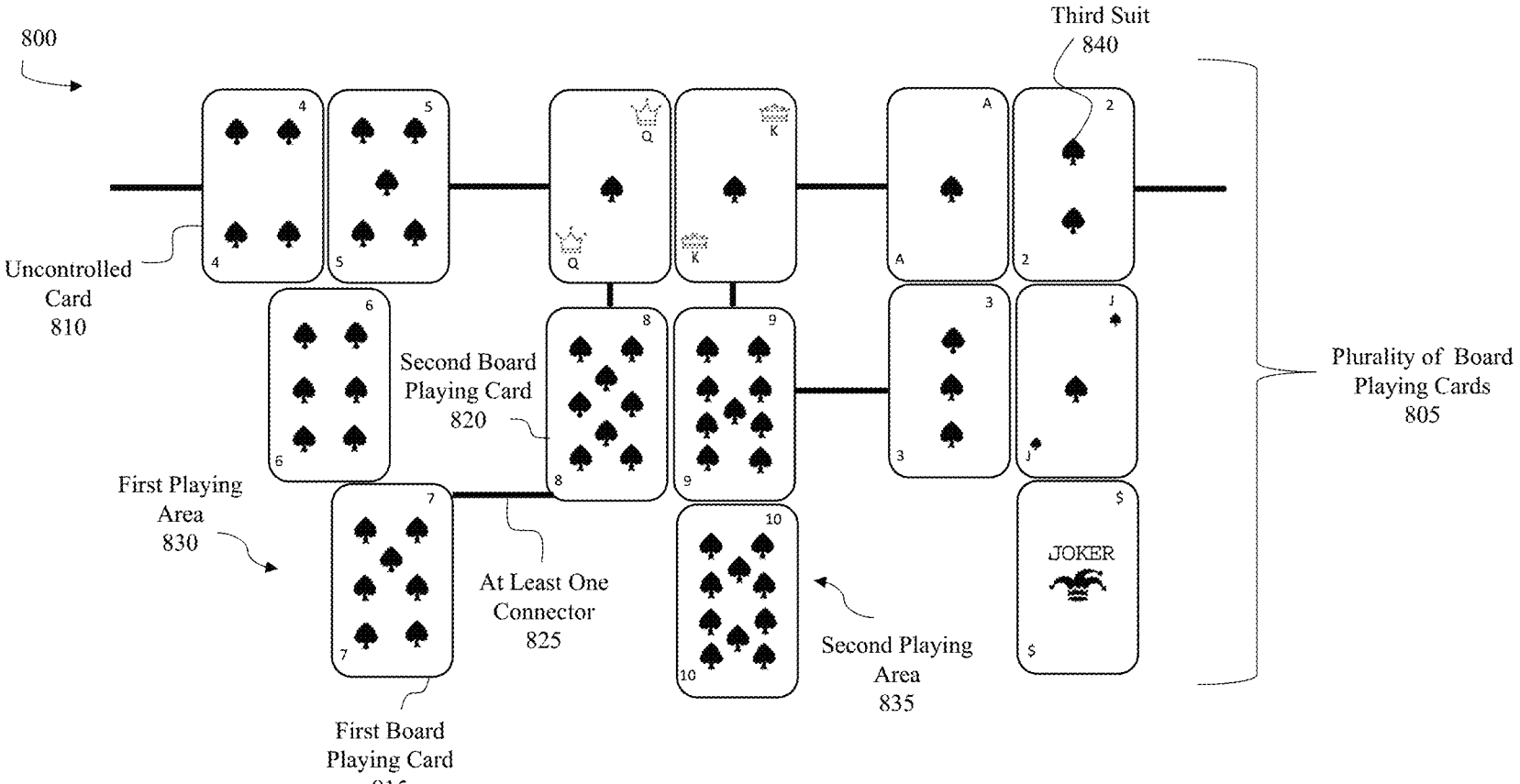
FIG. 8 is a graphical representation of the game board illustrating displaying the game board to the first player and second player.

In certain embodiments, an adjacent or an adjacent card means a board playing card is positioned above, below, to the right, or to the left of another board playing card. In certain other embodiments, the term adjacent playing card is deemed to adjacent if a first board playing card 815 of FIG. 8 is connected to a second board playing card 820 of FIG. 8 via the at least one connector 825 of FIG. 8. For example, referring to FIG. 6, the ace of spades 601 is adjacent to the two of spades 602 because the two of spades is directly to the right of the ace of spades. The ace of spades is also adjacent to the three of spades 603 because the ace of spades is directly above the three of spades and the three of spades is directly below the ace of spades. The ace of spades is also adjacent to the king of spades 613 because they are connected by the fifth connector 619. The ace of spades is not adjacent to the jack of spades 611.

The connector's in FIG. 6 including first connector 615, second connector 616, third connector 617, fourth connector 618, fifth connector 619, sixth connector 620, and seventh connector 621, may include at least one of an elongated mark and an elongated structure positioned such that the elongated structure spans from the first playing area 830 of FIG. 8 to the second playing area 835 of FIG. 8. In one embodiment, the elongated structure may be made from a variety of materials including wood, plastic, metals in a variety other material. In other embodiments, the elongated structure may be formed from markings between the areas. In one embodiment, the game board has more than seven connectors. In one embodiment, the game board has fewer than seven connectors. The connectors allow the board playing cards to become adjacent with one another increasing the interaction between the first player and second player. For example, in FIG. 6, if a first player started playing in the first area and second area, then the first player would have to control a board playing card in another area by way of one of three connectors. The connectors may be an elongated structure connecting a first board playing card to a second board playing card. The structure may include a three-dimensional elongated structure embossed on the game board, a debossed relief on the game board, an elongated structure attached to the game board, an elongated structure removably attachable to the game board. The elongated structure may also be a visual representation of a connector on the game board to connect a first board playing card in a first playing area with a second board playing card in a second area to configure the first board playing card adjacent to the second board playing card. In one embodiment, the game board includes a graphical representation of at least one connector consistent with this disclosure.

Figure 7A:
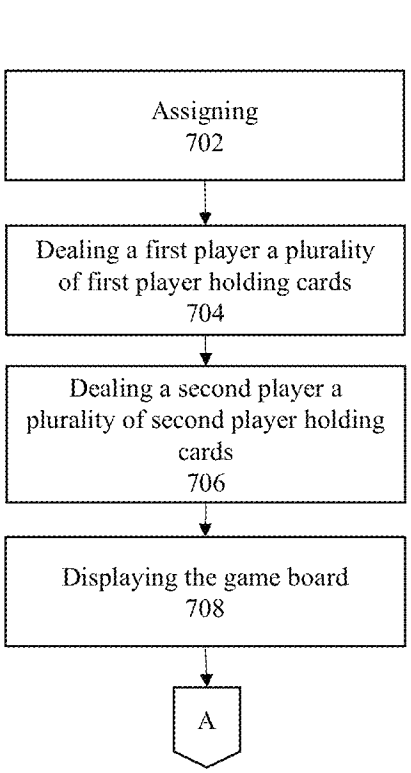
FIG. 7A is a flowchart illustrating a method including assigning suits, dealing holding cards, and setting up the game board, according to an example embodiment.

Referring now to FIG. 7A, FIG. 7A is a flowchart illustrating a method 700 including assigning suits, dealing holding cards, and setting up the game board, according to an example embodiment. A method 700 of playing a card game using a game board defined by a plurality of areas defined by playing cards from a deck of cards, wherein the object of the game is to accumulate a straight flush on one of the plurality of areas or in a player's hand.

Figure 10:
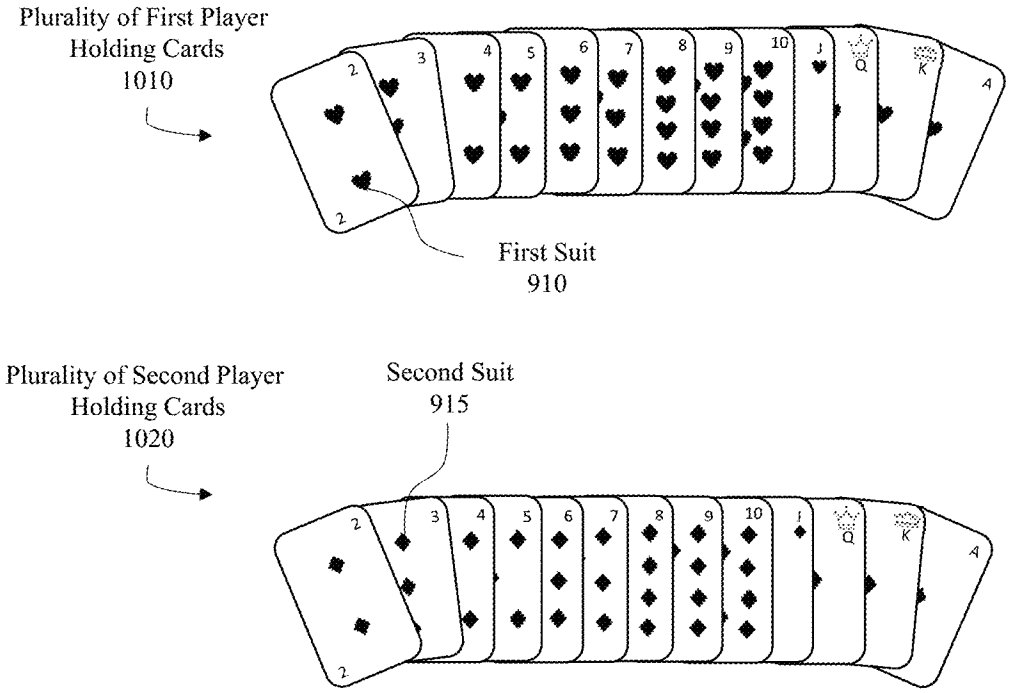
FIG. 10 illustrates a plurality of first player holding cards and a plurality of second player holding cards, according to an example embodiment.

The method includes assigning 702 the first player 110 a first suit 910 of FIG. 9 and the second player 120 a second suit 915 of FIG. 9, as shown in FIG. 10. The first suit may include one of suit of a deck of cards, including one of a suit of hearts, a suit or spade, a suit of clubs, and a suit of diamonds. However, it is understood that if the initial cards displayed on the board or all spades (except the Joker) as illustrated in FIG. 5B above, then the first suit may not be a spade. The second suit may include one of suit of a deck of cards, including one of a suit of hearts, a suit of spades, a suit of clubs, and a suit of diamonds, excluding the suit assigned to the first player and the card initially displayed on the board. Neither the first player nor the second player can be assigned the same suit. For example if the first player is assigned a first suit including the suit of hearts, then the second player is assigned the second suit including one of the suit of spades, the suit of clubs, and the suit of diamonds. In other embodiments if there is a third player 130, then the third player will be assigned a fourth suit including one of a suit of hearts, a suit of spades, a suit of clubs, and a suit of diamonds, excluding the first suit assigned to the first player and the second suit assigned to the second player. For example, if the first player is assigned the first suit including the suit of hearts, and the second player is assigned the second suit including the suit of diamonds, then the third player is assigned the fourth suit including one of the suit of clubs and the suit of spades. After the first player and the second player are assigned a first suit and second suit respectively, dealing a first player a plurality of first player holding cards 704. The first player holding cards are all a first suit of the deck of cards, where only the first suit is assigned to the first player. Next, dealing the second player a plurality of second player holding cards 706. The second player holding cards are all a second suit of the deck of cards, where only the second suit is assigned to the second player. In one embodiment the server 102 transmitting, by the processor, assigning 702 the first player 110 a first suit 910 of FIG. 9 and the second player 120 a second suit 915 of FIG. 9. The system 100, transmitting to at least one of a first computing device and a second computing device, information corresponding to dealing a plurality of first player holding cards are all a first suit of a deck of playing cards 704, where only the first suit is assigned to the first player, and where the first computing device comprises a first display and where the second computing device comprises a second display. In one embodiment, the system 100 transmitting, by the processor, to at least one of a first computing device and a second computing device, information corresponding to dealing a plurality of second player holding cards 706, where the second player holding cards are all a second suit of the deck, where only the second suit is assigned to the second player. In one embodiment the dealer 140 assigning the first suit to the first player and the second suit to the second player and dealing the first player the plurality of first player holding cards and the second player the plurality of second player holding cards.

Following dealing the second player a plurality of second player holding cards, displaying the game board 708 to the first player and second player. The game board may include displaying on at least one of the first display, second display, third display, and display of system 100. The game board may further include displaying the game board 708 on at least one of the first computing device, second computing device, and third computing device. The game board may also be displayed by displaying at least one of the first player and second player a physical game board including a plurality of areas and board playing cards. The game board includes a plurality of board playing cards from the deck of playing cards, and where the plurality of board playing cards displayed on the game board define the plurality of areas. The plurality of board playing cards include a suit of cards from the deck of cards including one of the suit of hearts, suit of diamonds, suit of clubs, and suit of spades, not including the first suit assigned to the first player and the second suit assigned to the second player. For example, if the first player is assigned first suit including the suit of hearts and the second player is assigned the second suit including the suit of diamonds, then the plurality of board playing cards may only include one of the suit of spades and the suit of clubs. In embodiments where there is a third player 130, the plurality of board playing cards shall not include the suit assigned to the third player. For example, if the first player is assigned the first suit including the suit of hearts, and the second player is assigned the second suit including the suit of diamonds, then the third player is assigned the fourth suit including the suit of clubs, then the board playing cards include the suit of spades. In one embodiment, the system 100, transmitting, by the processor, to at least one of a first computing device and a second computing device, information corresponding to displaying the game board 708 including displaying a plurality of board playing cards from the deck of playing cards defining a plurality of areas to be displayed on at least one of a first display and a second display.

Figure 7B:
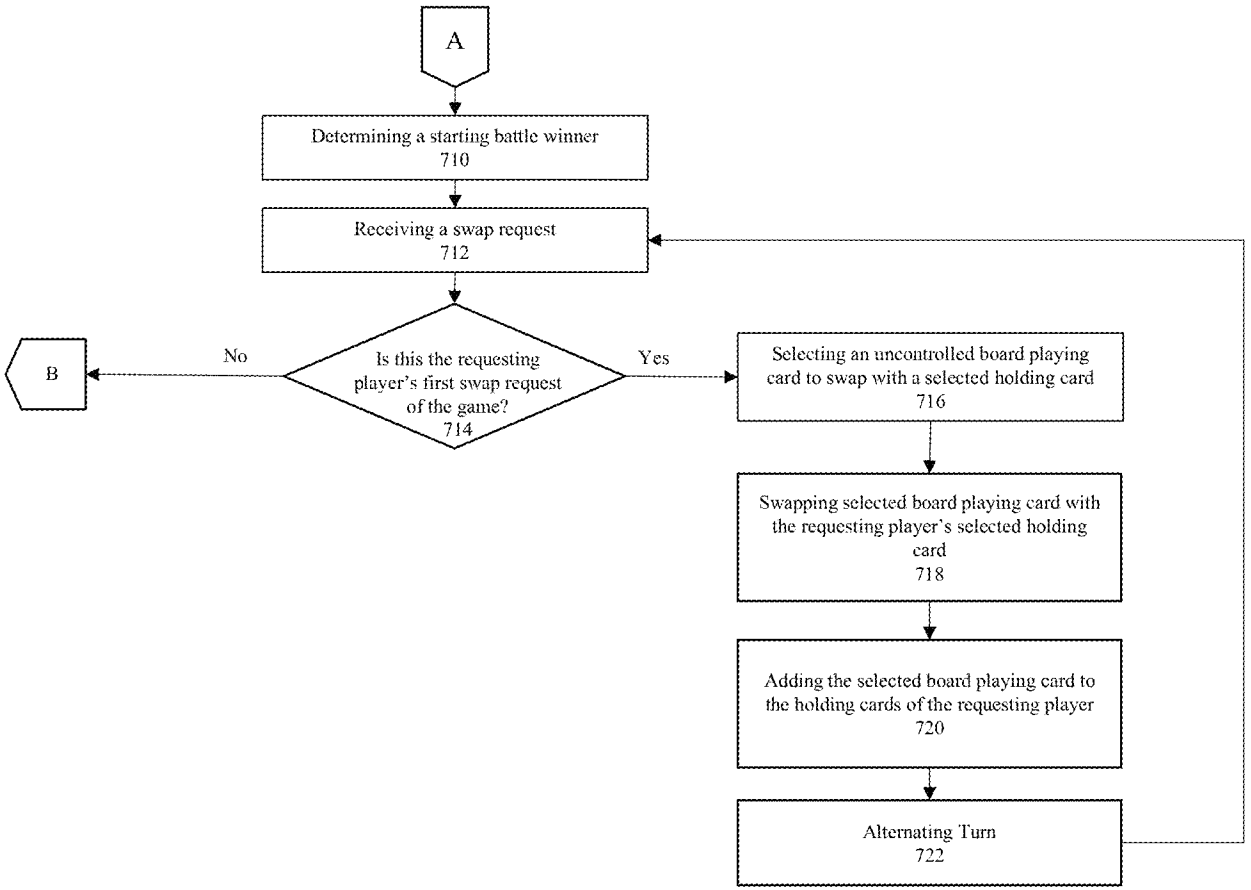
FIG. 7B is a flowchart illustrating the method including deciding which one of the first and second player goes first, and receiving the first player swap requests, according to an example embodiment.

FIG. 7B is a flowchart illustrating in embodiment of a method 700 including deciding which one of the first player and second player plays first, and for receiving the first player swap requests, according to an example embodiment. The embodiment of FIG. 7B continues the method disclosed in FIG. 7A via the connector A. The method includes deciding which of the first player and second player submits a swap request first by determining a starting battle winner 710. Before receiving a swap request 712, the process includes determining which of one of the first player and second player are to send a first swap request by determining a starting battle winner including having a first player starting battle card randomly selected from the plurality of first player holding cards; having a second player starting battle card randomly selected from the plurality of second player holding cards; and, selecting a starting battle winner between the first player starting battle card and second player starting battle card, where the starting battle winner is one of the first player having a first player starting battle card having a ranking greater than the second player starting battle card and the second player having a second player starting battle card having a greater ranking than the first player starting battle card. In one embodiment, determining a starting battle winner may include flipping a fair coin, rolling a fair die, playing rock, paper, scissors, and other methods of determining a winner. It is understood that the greater ranking may be determined according to standard poker rules.

Once it is determined that one of the first player and second player goes first, the process then moves to receiving a swap request 712 from the requesting player, where the requesting player is one of the first player and the second player, to swap a selected holding card from one of a requesting player's holding cards with a selected board playing card of one of the plurality of board playing cards. In one embodiment the server 102, receives, from a requesting player device, information corresponding to receiving a swap request 712 from a requesting player, where the requesting player device is one of the first player computing device and second player computing device, to swap a selected holding card from one of a requesting player's holding cards with a selected board playing card of one of the plurality of board playing cards. In one embodiment the game board will receive the swap request (step 712) through the dealer 140, from the requesting player, where the requesting player is one of the first player and second player.

After receiving the swap request (step 712), the process moves to the step determining if the swap request is the requesting player's first swap request of the game (step 714). If the swap request is the requesting players first swap request of the game, then the process move to selecting an uncontrolled board playing card and swapping the selected board playing card with the requesting player's selected holding card (step 718), then adding the selected board playing card to the requesting player's holding cards (step 720). Next, players will alternate turns (step 722), where the requesting player becomes the opposing player, and the opposing player becomes the requesting player. For example, if the first player was the requesting player and a swap request (step 712) was executed by the system 100, then after alternating turns, the second player would now become the requesting player. If the receiving swap request (step 712) was not the requesting players first swap request then game board receives the swap request (step 712), continuing to FIG. 7C via connector B.

Figure 7C:
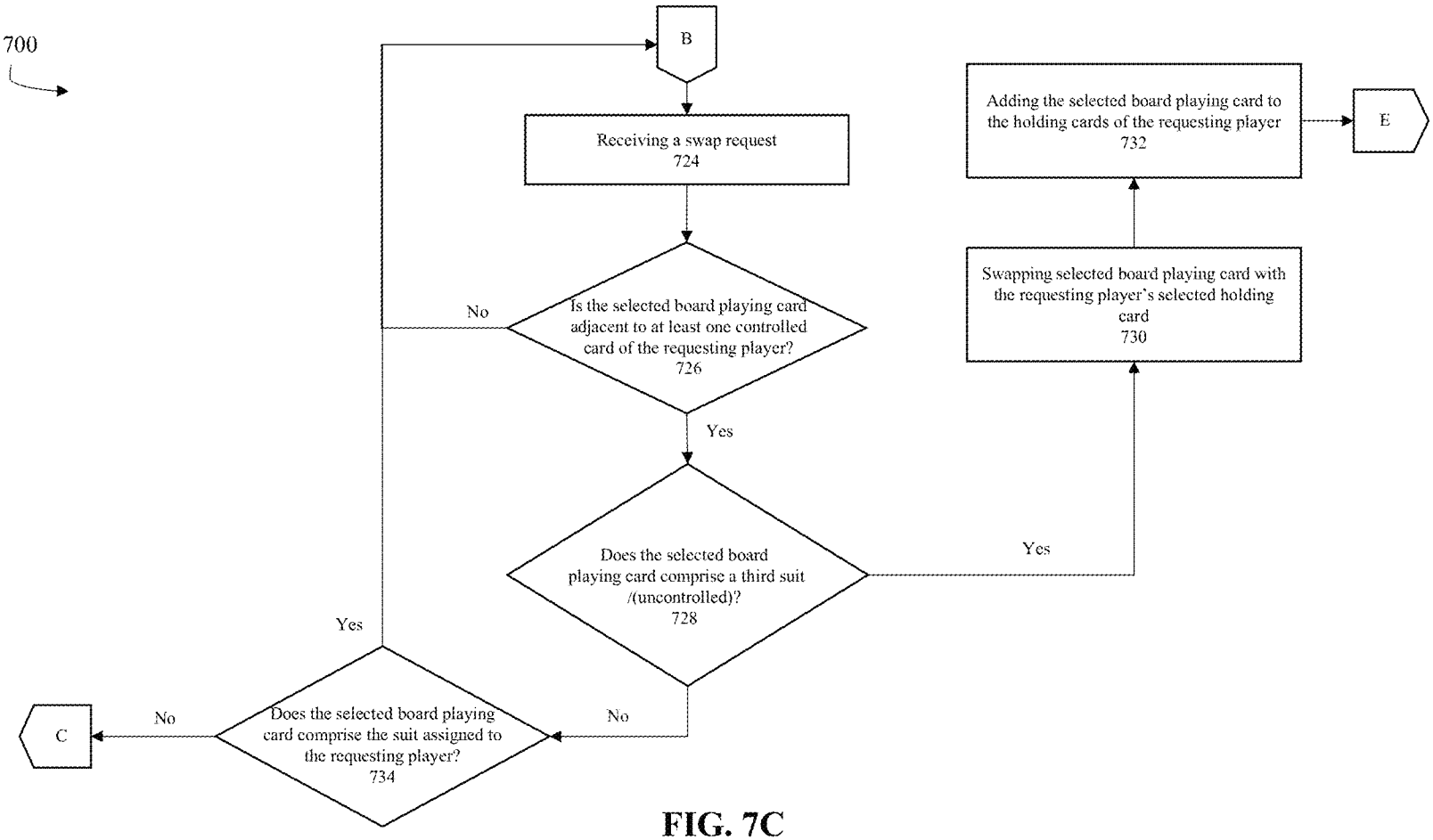
FIG. 7C is a flowchart illustrating the method including receiving a player swap request, is according to an example embodiment.

FIG. 7C is a flowchart illustrating the method 700 including receiving a player swap request, is according to an example embodiment. After receiving the swap request (step 724), the process move to step 726 and processor uses information sent by the requesting player and information about the board to determine if the selected board playing card is adjacent to at least one controlled card of the requesting player. The requesting player's-controlled card comprises the suit assigned to the requesting player. It is also understood that in certain embodiments the game is not electronically performed, the dealer may be able to make similar determinations to that of the processor. If the processor or dealer determines that the selected board playing card is adjacent to at least one controlled card of the requesting player, then the process moves to step 728. On the other hand, if the processor or dealer determines that the selected board playing card is not adjacent to at least one controlled card of the requesting player, then the process moves back to step connecter B or the dealer tells the requesting player to select another card. Next in step 728, after it has been determined that the selected board playing card is adjacent to at least one of the controlled cards of the requesting player, the processor or dealer determines if the selected board playing card is an uncontrolled card. The uncontrolled card is a card that that comprises this third suit. The third suit in certain embodiments is a Spade as illustrated in FIG. 5B. Next, if it is determined that the selected board playing card is an uncontrolled card or comprises a third suit, then this process moves to step 730. On the other hand, if the processor or dealer determines that these selected board playing card does not comprise an uncontrolled card then the process moves to step 734. As mentioned above, the uncontrolled card comprises a third suit and where the requesting player's controlled card comprises the suit assigned to the requesting player.

In step 730, the processor sends information for swapping the selected board playing card with the selected holding card of the requesting player. It is important to note that after a selected holding card of the requesting player is swapped for the selected board playing card, then the selected holding card becomes a board playing card after the swap. It is also important to note that the requesting player's holding card now displayed on the game board swapped for the selected board playing card becomes a controlled card of the requesting player. Next, the process moves to step 732 and including or adding the selected board playing card to the requesting player's holding cards.

Alternatively, after receiving the swap request, if the selected board playing card does not include a third suit, then the process moves to step 734, to determine whether the selected board playing card of the requesting player includes the suit assigned to the requesting player. In step 734, in one embodiment, if the selected board playing card includes the suit assigned to the requesting player then swapping the selected board playing card with the requesting player's holding card 730, then adding the selected board playing card to the requesting player's holding cards 732. If the selected board playing card does not include the suit assigned to the requesting player 734 then continuing to FIG. 7D via connector C, which requires users to battle (1640 of FIG. 16B) over the territory, controlled card, or selected board playing card.

Figure 7D:
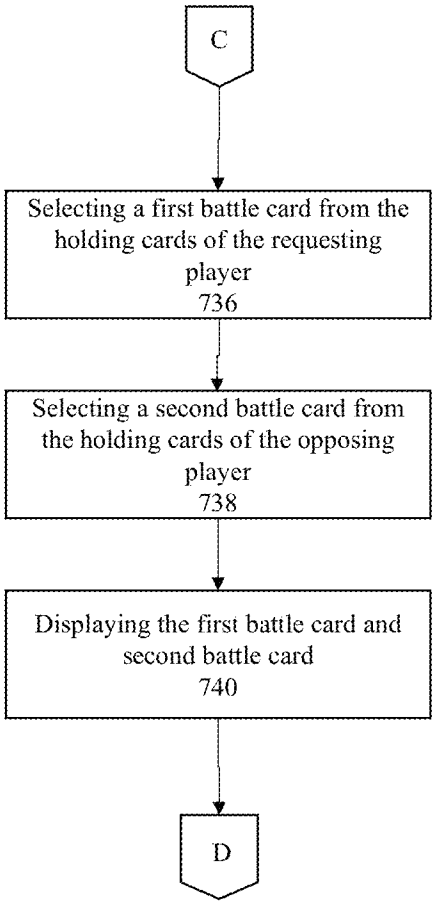
FIG. 7D is a flowchart illustrating the method including a battle, according to an example embodiment.

FIG. 7D is a flowchart illustrating the method 700 including a battle, according to an example embodiment. The method further includes, in step 736, selecting a first battle card from the requesting player's holding cards and then in step 738, selecting a second battle card from the opposing player's holding cards. After selecting the first battle card and second battle card, in step 740, the processor or dealer has the first battle card and second battle card displayed to the requesting player and the opposing player. As mentioned above, the processor is configured to receive information packets from either the first or second player, analyze the information packets in order to make the determination is required. The same functions may be also performed by the dealer. The process displayed in FIG. 7D is a battle which occurs if the selected board playing card request the requesting player is an opposing player's controlled card, where the opposing player is one of the first player and second player that is not the requesting player, and where the requesting player's selected board playing card is adjacent to one of the requesting player's controlled cards. As mentioned above, in step 740, the process then moves to having displayed both a first battle card of the requesting player and a second battle card of the opposing player where the first battle card is randomly selected from the requesting player's holding cards and the second battle card is randomly selected from an opposing player's holding cards.

In one embodiment, if the processor determines that information sent in the swap request or that the swap request corresponds to that the selected board playing card is one of the opposing player's controlled cards, then transmitting, with the processor, to at least one of the requesting player computing device and opposing player computing device, information corresponding to a request for a first battle card randomly selected from the requesting player's holding cards and a request for a battle card randomly selected from the opposing player's holding cards.

Randomly selecting the battle cards may include shuffling the requesting player's holding cards and the opposing player respectively and selecting the first battle card from the shuffled requesting player's holding cards and the second battle card form the shuffled opposing player'; performing an algorithm to randomly select the first battle card and second battle card; and the requesting player selecting the first battle card and the opposing player selecting the second battle card; and other methods including random selection of playing cards consistent with this disclosure. After displaying the first battle card and the second battle card, the method further including the embodiment of FIG. 7E via connector E.

Figure 7E:
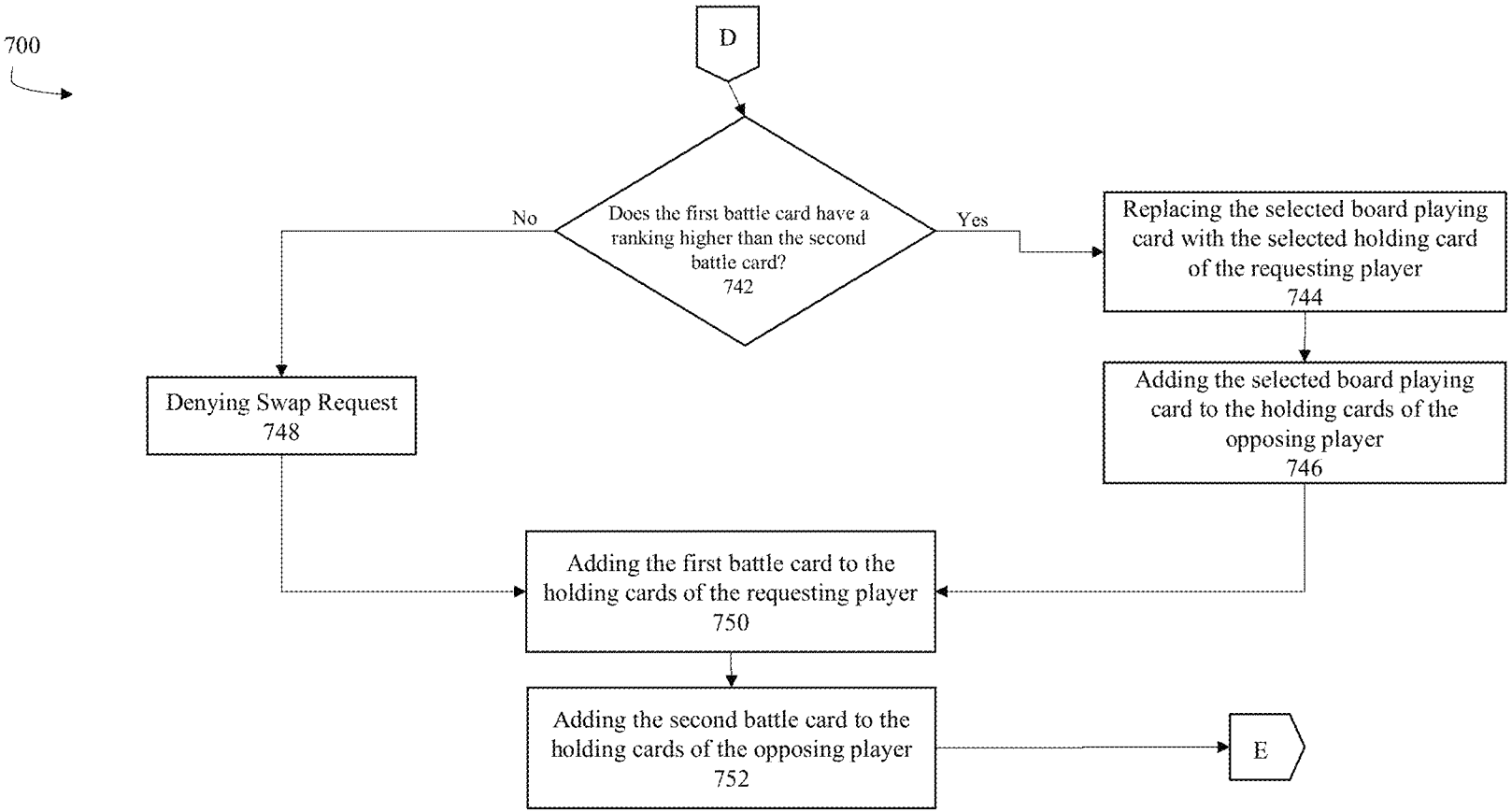
FIG. 7E is a flowchart illustrating the method including deciding a battle winner and determining a card ranking, according to an example embodiment.

FIG. 7E is a flowchart illustrating the method 700 including deciding a battle winner and determining a card ranking, according to an example embodiment. The method including deciding, in step 742, whether the first battle card has a ranking greater than the second battle card. The ranking of the battle card may include rankings such that a first suit may have a higher value than the second suit. For example, the first battle card including the suit of diamonds may be greater than the second battle card including the suit of clubs. The ranking may also include playing cards having an order of value including one of value such that the value of the playing card from lowest ranking to highest ranking includes ace, two, three, four, five, six, seven, eight, nine, ten, jack, queen, king; the lowest ranking to highest ranking including two, three, four, five, six, seven, eight, nine, ten, jack, queen, king, ace; and any other ranking system consistent with current playing card games. The ranking may further include a predetermined value established for each of the playing cards from the deck of cards. The predetermined value may include the face value of each card from the plurality of cards from the deck of cards or any predetermined value consistent with this disclosure.

After the first battle card of the requesting player and the second battle card of the opposing player are displayed in step 740, the process moves to step 742 to make the determination if that the requesting player is a battle winner. If the first battle card of the requesting player card has a ranking greater than the second battle card of the opposing player then the process moves to step 744 and the selected board playing card is replaced with the selected holding card of the requesting player. Next, in step 746, the selected board playing card is added to the opposing player's holding cards and then in step 750 adding the first battle card of the requesting player to the requesting player's holding cards and then in step 752 adding the second battle card of from the opposing player to the opposing player's holding cards.

In one embodiment, after the first battle card of the requesting player and the second battle card of the opposing player are selected (as in step 736 and 738) the method includes, in step (742) determining with the server 102 via the processor that the requesting player is a battle winner when information corresponding to the first battle card of the requesting player has a ranking greater than the second battle card of the opposing player, and sending to least one of requesting player computing device and opposing player computing device information corresponding to 1) replacing the selected board playing card with the selected holding card of the requesting player (step 744), 2) adding the selected board playing card to the opposing player's holding cards (step 746); and, 3) adding the first battle card of the requesting player to the requesting player's holding cards (step 750) and adding the second battle card of the opposing player to the opposing player's holding cards (step 752).

Determining whether the first battle card has a ranking higher than the second battle card 742 further includes determining whether there is a battle tie. A battle tie occurs when the first battle card and the second battle card have an equivalent ranking. For example, the first battle card including the 8 of hearts may be equivalent to the second battle card including the eight of diamonds. Therefore, determining that there is a battle tie. The method further includes determining a battle tie between the requesting player and opposing player if the second battle card of the opposing player has the ranking equal to the ranking of the first battle card of the requesting player and performing at least one of the following including 1) having displayed a third battle card of the requesting player and a fourth battle card of the opposing player where the third battle card is randomly selected from the requesting player's holding cards and the fourth battle card is randomly selected from the opposing player's holding cards for determining the a battle winner; 2) determining that the requesting player is the battle winner and performing steps 744, 746, 750, and 752; and 3) determining that the requesting player is the battle loser and performing steps 748, 750, 752.

After the first battle card of the requesting player and the second battle card of the opposing player are displayed (step 740), then in step 742, determining the requesting player is a battle loser if the second battle card of the opposing player has the ranking greater than the first battle card of the requesting player; and 1) (step 748) not replacing the selected board playing card with the selected holding card by denying the swap request, and 2) (step 750) adding the first battle card of the requesting player to the requesting player's holding cards and adding (step 752) the second battle card of the opposing player to the opposing player's holding cards. In one embodiment after both the first battle card of the requesting player and the second battle card of the opposing player are displayed (step 740), then determining with the server 102 via the processor that that opposing player is the battle winner when information corresponding to the second battle card of the opposing player has the ranking greater than the first battle card of the requesting player (step 742) and sending to least one of requesting player computing device and opposing player computing device information corresponding to denying the swap request (step 748) by 1) not replacing the selected board playing card with the selected holding card, and 2) adding the first battle card of the requesting player to the requesting player's holding cards (step 750) and adding the second battle card of the opposing player to the opposing player's holding cards (step 752). The method 700 further includes determining whether the requesting player accumulated a winning hand as illustrated in FIG. 7F via connector E.

Figure 7F:
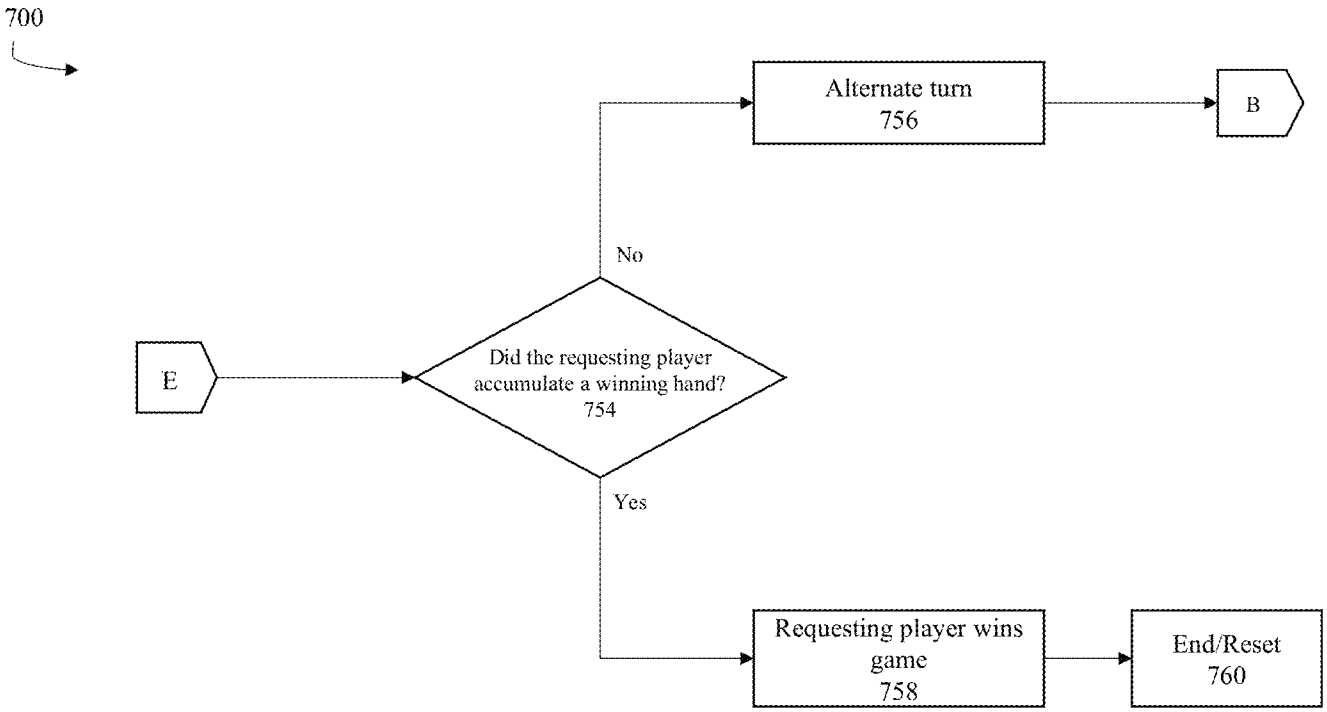
FIG. 7F is a flowchart illustrating the method including accumulating a winning hand, according to an example embodiment.

FIG. 7F is a flowchart illustrating the method 700 including accumulating a winning hand, according to an example embodiment. After adding the first battle card of the requesting player to the requesting player's holding cards (step 750) and adding the second battle card of the opposing player to the opposing player's holding cards (step 752), the method further including deciding whether the requesting player accumulated a winning hand (step 754). A winning hand may include a straight flush of board playing cards including the third suit in the requesting player's holding cards hand, and a straight flush of the requesting player's controlled cards on the game board as board playing cards; and any other winning hands consistent with playing poker such as a royal flush, a straight flush, four of a kind, a full house, a flush, a straight, three of a kind, two pair, and high card determined by ranking. If the requesting player does not accumulate a winning hand, then alternating turns (step 756) where the requesting player becomes the opposing player and the opposing player becomes the requesting player the game board receives a swap request (step 724) from the requesting player. The method 700 continues until determining in step 754 that the requesting player accumulated a winning hand, where the first player and second player alternate turns for sending swap requests until one of the first and second player accumulates a winning hand, such as a straight flush, to win the card game. When the requesting player accumulates a winning hand (in step 754), the requesting player wins the game (as shown in step 758) then ending or resetting the game board (step 760) back to the original board all having the same suit, same orientation and same value as displayed in FIG. 4B or 5B. In one embodiment, the first player and second player alternate turns for sending swap requests until the server 102 via the processor determines information corresponding to determining that one of the first player and second player accumulates a winning hand.

With reference now to FIG. 8, FIG. 8 is a graphical representation of displaying the game board 800 to the first player and second player including a plurality of board playing cards 805 from the deck of playing cards and where the plurality of board playing cards displayed on the game board define the plurality of areas. Before receiving a swap request from one of the requesting player and the opposing player, all of the plurality of board playing cards positioned on the game board are uncontrolled cards 810. The game board further defines at least one connector 825, where the at least one connector 825 connects a first board playing card 815 of the plurality of board playing cards in a first playing area 830 of the plurality of areas of the game board with a second board playing card 820 of the plurality of board playing cards in a second playing area 835 of the plurality of areas of the game board, and wherein the method is configured such that if the first playing card and second playing card are connected by the connecter, then the first playing card and second playing card are adjacent. The first playing area may include one of the first area, second area, third area, fourth area, and fifth area of FIG. 4A. The second playing area may include one of the first area, second area, third area, fourth area, and fifth area of FIG. 4A not including the first playing area. The first board playing card may include any board playing card of the plurality of board playing cards in the first playing area. The second board playing card may include any board playing card of the plurality of board playing cards in the second playing area. The at least one connector may include one of the first connector, second connector, third connector, fourth connector, fifth connector, sixth connector, and seventh connector of FIG. 6. As shown in FIG. 8, the plurality of board playing cards include the third suit 840 including the suit of spades. The plurality of board playing cards are positioned such that game board includes four playing cards in the first area are a four of spades adjacent and to the left of a five of spades, a six of spades adjacent and below the four and five of spades, and a seven of spades adjacent and below the six of spades; two playing cards in the second area are a queen of spades adjacent and to the left of the king of spades, where the queen of spades is connected by a first connector to the five of spades; three playing cards in the third area are an eight of spades adjacent and to the left of a nine of spades and a ten of spades adjacent and below the nine of spades, where the eight of spades is connected by a second connecter to the queen of spades and by a third connector to the seven of spades, and where the nine of spades is connected by a fourth connector to the king of spades; four playing cards in the fourth area are an ace of spades adjacent and to the left of a two of spades, a three of spades below and adjacent to the ace of spades, a jack of spades below the two of spades and adjacent to both the three of spades and the two of spades; a fifth connector connects the king of spades with the ace of spades, a sixth connector connects the two of spades and the four of spades, and a seventh connector connects the three of spades and the nine of spades; and wherein the one playing card in the fifth area is a joker adjacent to the jack of spades. The board displayed FIG. 6 for example provides an increased amount of player enjoyment over other embodiments. Additionally, the present board displayed in FIG. 6 creates an increased amount of action.

In addition to the aforementioned embodiments of the game board, the game board may be displayed as a graphical representation on a remote computing device consistent with FIG. 1 of system 100, and the game board may be displayed as a pattern of plurality of cards, including the plurality of board playing cards, configured such that the plurality of board playing cards define the plurality of areas of the game board.

FIG. 9 illustrates a deck of cards 900, according to an example embodiment. The deck of cards include the third suit 920 where the plurality of board playing cards includes the third suit, the first suit 910 where the plurality of first player holding cards includes the first suit, the second suit 915 where the second player holding cards includes the second suit; and the fourth suit 925 such that a third player's holding cards may include the fourth suit. The deck of cards may include a standard deck of cards including the suit of spades exampled as the third suit, the suit of hearts exampled as the first, the suit of diamonds exampled as the second suit, the suit of clubs exampled as the fourth suit, and two wild cards such as jokers. As illustrated in the example embodiment of FIG. 9, the first suit 910 includes the suit of hearts, the second suit 915 includes the suit of diamonds, and the third suit 20 includes the suit of spades. The deck of cards 900 includes playing cards 905 where the plurality of board playing cards 805 of FIG. 8 includes the playing cards of the third suit.

FIG. 10 illustrates the plurality of first player holding cards 1010 and the plurality of second player holding cards 1020, according to an example embodiment. After dealing the first player a plurality of first player holding cards that are all a first suit of a deck of playing cards, where only the first suit is assigned to the first player, the plurality of first player holding cards are displayed to the first player. In one embodiment the first player holding cards may be displayed on the first player computing device 112 of system 100 operated by the first player 110. After dealing the second player a plurality of second player holding cards that are all a second suit of a deck of playing cards, where only the second suit is assigned to the second player, the plurality of second player holding cards are displayed to the second player. In one embodiment the second player holding cards may be displayed on the second player computing device 112 of system 100 operated by the second player 120. In one embodiment the plurality of first player holding cards is displayed to the first player via the dealer 140 of FIG. 3 and operated under the control of the first player. In one embodiment the plurality of second player holding cards is displayed to the second player via the dealer 140 of FIG. 3 and operated under the control of the second player.

Now referring to FIG. 11A-FIG. 18B, the method 700 is illustrated as displayed, received, and transmitted, by system 100 according to example embodiments.

Figure 11A:
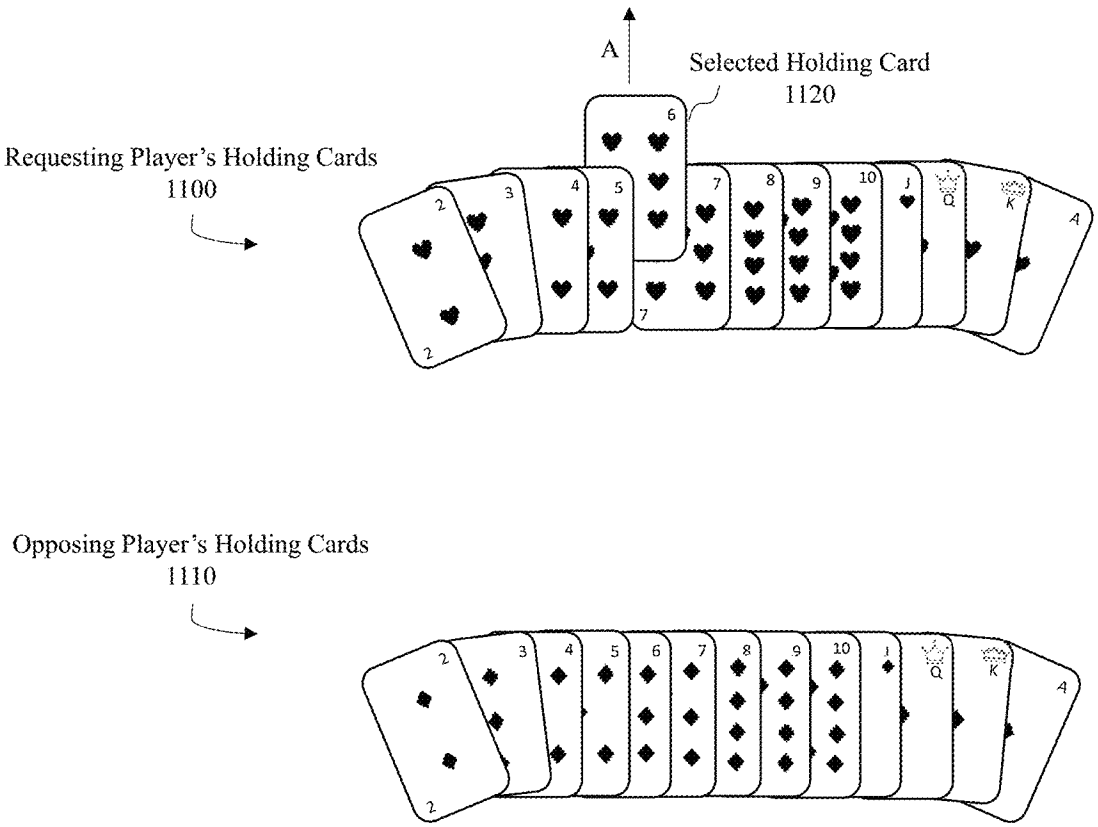
FIG. 11A illustrates selecting a holding card from a plurality of first player holding cards depicted as a requesting player's holding cards, according to an example embodiment, according to an example embodiment.

FIG. 11A illustrates selecting (line A) a selected holding card 1120 from the plurality of first player holding cards 1010 of FIG. 10 depicted as a requesting player's holding cards 1100 and illustrating the plurality of second player holding cards 1020 of FIG. 10 depicted as an opposing player's holding cards 1110, according to an example embodiment, according to an example embodiment. As shown in FIG. 11A the requesting player, sent a swap request to the game board by selecting the selected holding card 1120 from the requesting player's holding cards. The selected holding card is depicted at the six of hearts according to the example embodiment.

Figure 11B:
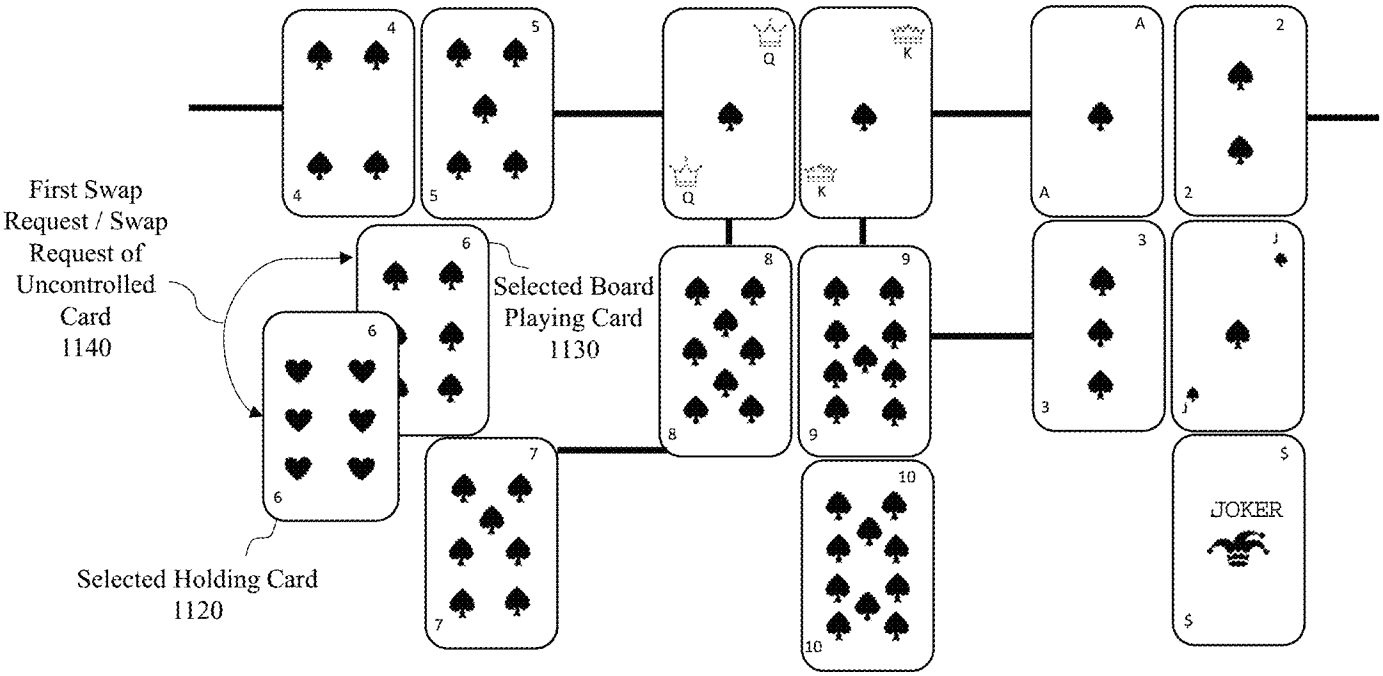
FIG. 11B illustrates the game board after receiving a swap request of an uncontrolled board playing card, according to an example embodiment.

FIG. 11B illustrates the game board 800 of FIG. 8 after receiving a swap request of an uncontrolled board playing card, according to an example embodiment. The selected holding card 1120 is displayed where the selected board playing card 1130 was positioned on the game board before the swap request was received. In one embodiment, the server 102 transmitting, with the processor, to at least one of the requesting player computing device and opposing player computing device, information corresponding to 1) displaying the selected holding card where the selected board playing card was positioned on the game board before the swap request was received. As shown in FIG. 11B, the selected holding card of the requesting player from FIG. 11A is displayed on the game board as the swap request (step 712 of method 700 and FIG. 7B) for the selected board playing card depicted as the six of spades. The selected board playing card includes the third suit, therefore, the selected board playing card is an uncontrolled card. Displayed on the game board is the first swap request 1140 where the first swap request is a swap request of an uncontrolled card. Therefore, swapping the selected board playing card with the selected holding card of the requesting player and adding the selected board playing card to the requesting player's holding cards, then alternating turns.

Figure 12A:
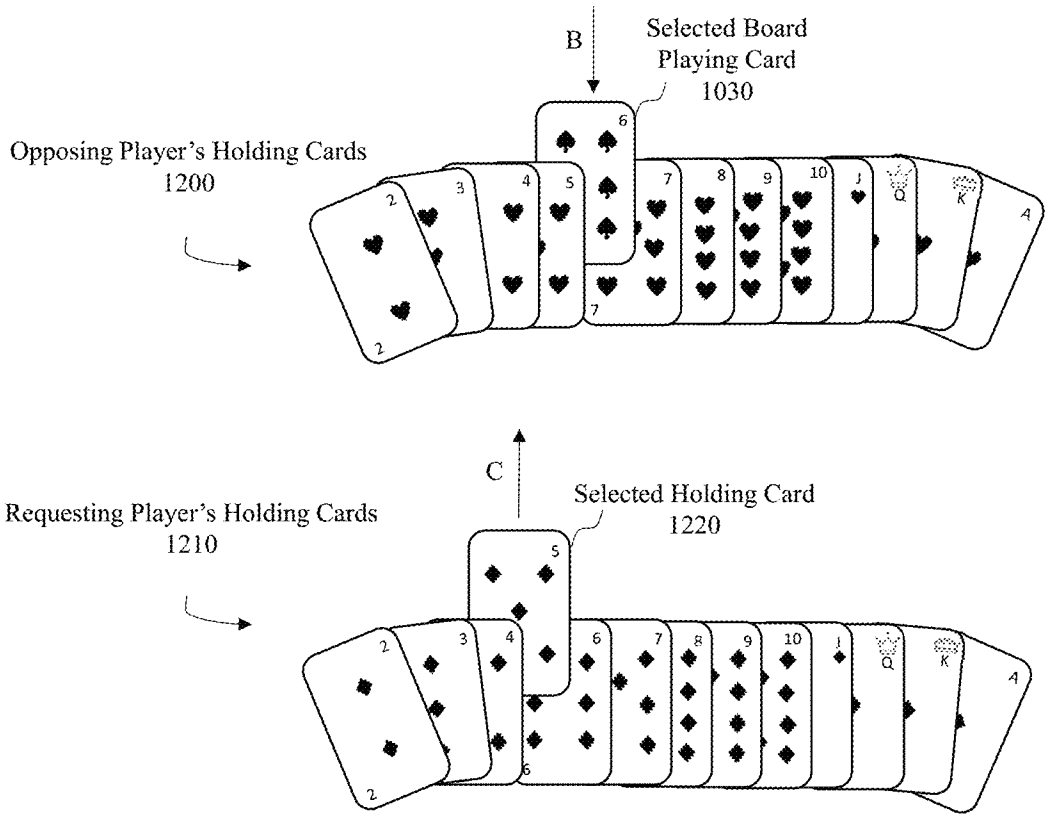
FIG. 12A illustrates the plurality of first player holding cards and second player holding cards after swapping, and alternating turns, according to an example embodiment.

FIG. 12A illustrates the plurality of first player holding cards and second player holding cards after swapping, and alternating turns, according to an example embodiment. The selected board playing card 1130 of FIG. 11B, depicted as the six of spades, is added (line B) to the plurality of first player holding cards depicted as the opposing player's holding cards 1200 as illustrated in FIG. 12A. It is important to note that the selected board playing card 1030 is added to the requesting player's holding cards, which was the first player when the request was made. The plurality of first player holding cards is depicted as the opposing player's holding cards because FIG. 12A is displaying the plurality of first player holding cards after the first player alternated turns with the second player. After alternating turns, the first player becomes the opposing player and the second player now becomes the requesting player. The second player, now the requesting player, selects (line C) a selected holding card 1220 from the requesting player's holding cards 1210 to send to a swap request to the game board. The selected holding card is depicted as the five of diamonds.

Figure 12B:
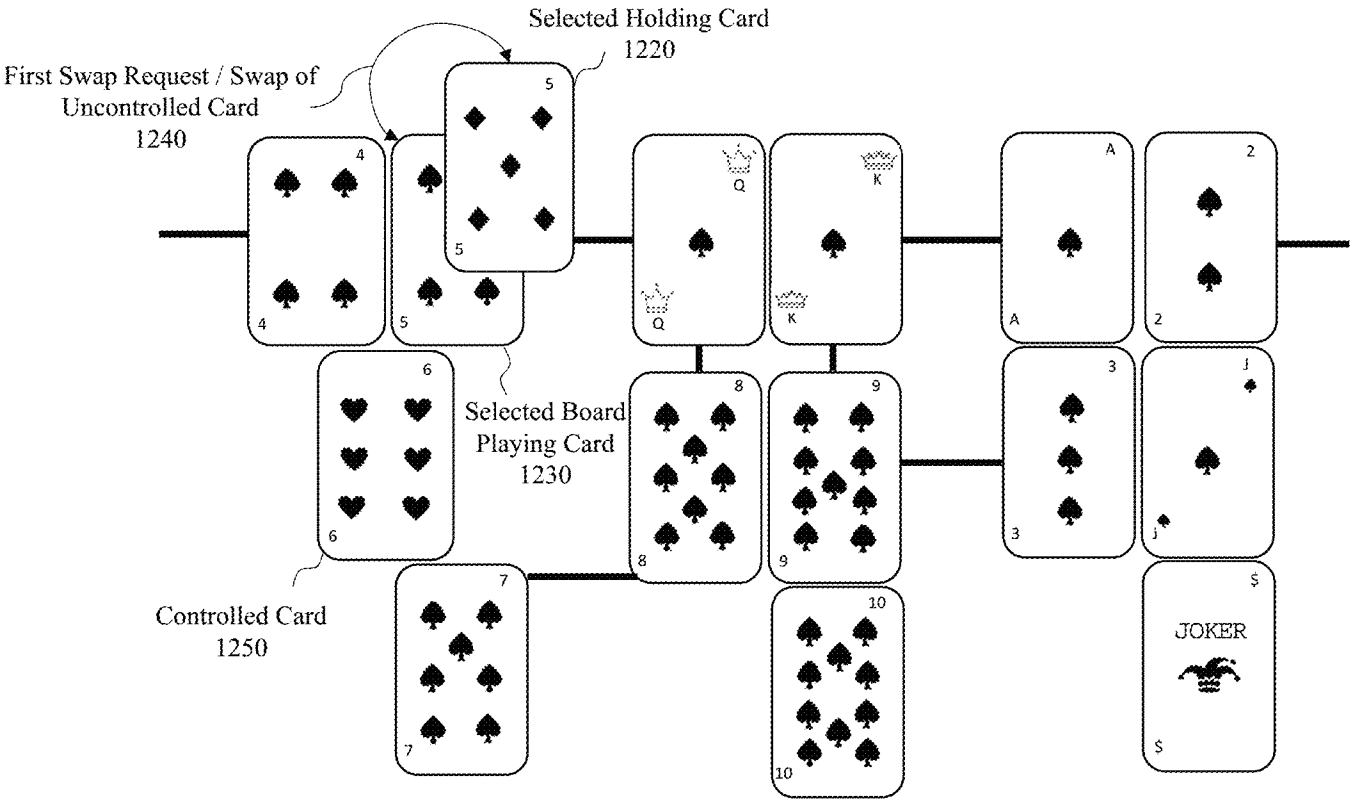
FIG. 12B illustrates the game board after receiving a first swap request of an uncontrolled board playing card, according to an example embodiment.

FIG. 12B illustrates the game board after receiving a first swap request of an uncontrolled board playing card, according to an example embodiment. The game board displays the selected holding card 1120 of FIG. 11B replaced with the selected board playing card 1130 of FIG. 11B. The selected holding card is now a controlled card 1250 of the first player of the plurality of board playing cards. The game board receives the swap request from the requesting player, the second player, which is the requesting player's first swap request 1240 where the swap request if of an uncontrolled card. The selected board playing card 1230 is depicted as the five of spades. Because the selected board playing card includes the third suit not assigned to the second player, the selected board playing card is an uncontrolled card. Therefore, swapping the selected board playing card with the selected holding card of the requesting player and adding the selected board playing card to the requesting player's holding cards, then alternating turns.

Figure 13A:
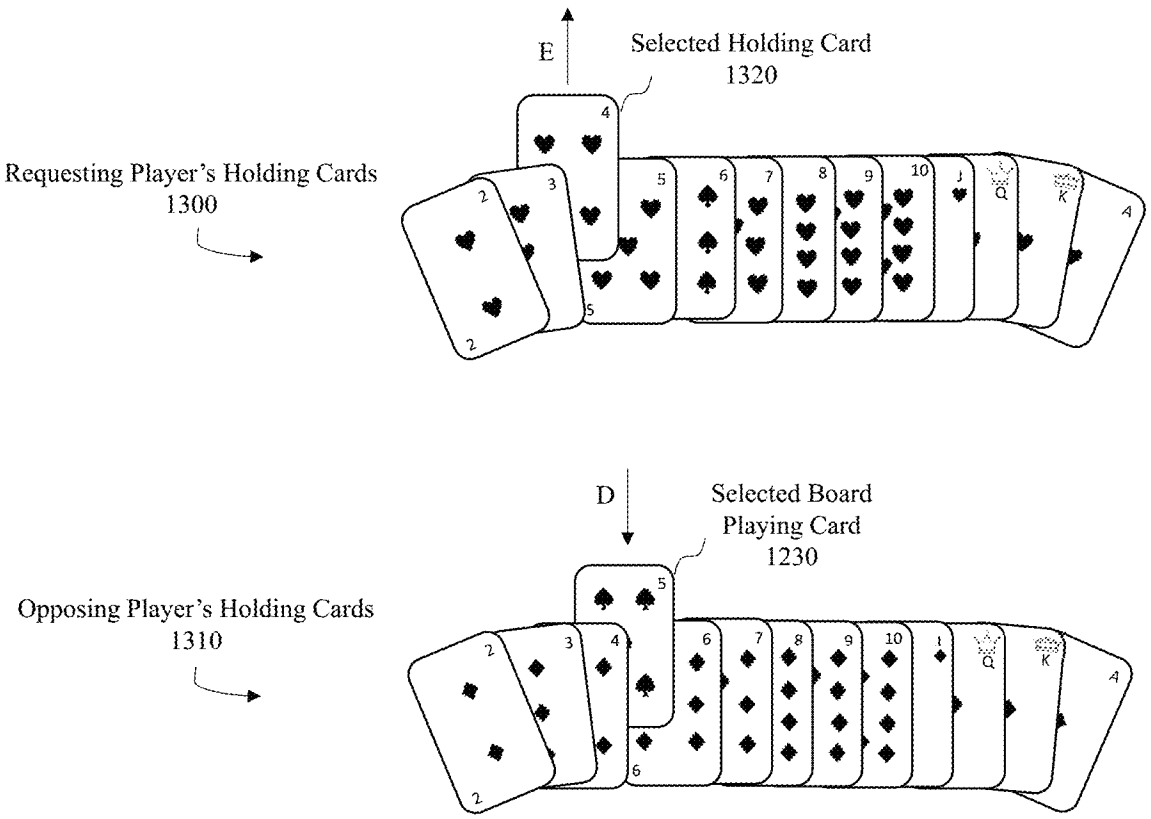
FIG. 13A illustrates the plurality of first player holding cards and second player holding cards after swapping, and alternating turns, according to an example embodiment.

FIG. 13A illustrates the plurality of first player holding cards and second player holding cards after swapping, and alternating turns, according to an example embodiment. The selected board playing card 1230 of FIG. 12B, depicted as the five of spades, is added (line D) to the plurality of second player holding cards depicted as the opposing player's holding cards 1300 as illustrated in FIG. 13A. It is important to note that the selected board playing card 1230 is added to the requesting player's holding cards, which was the second player when the request was made. The plurality of second player holding cards is depicted as the opposing player's holding cards because FIG. 13A is displaying the plurality second player holding cards after the second player alternated turns with the first player. After alternating turns, the first player becomes the requesting player and the second player now becomes the opposing player. The first player, now the requesting player, selects (line E) a selected holding card 1320 to send to a swap request to the game board. The selected holding card is depicted as the four of diamonds.

Figure 13B:
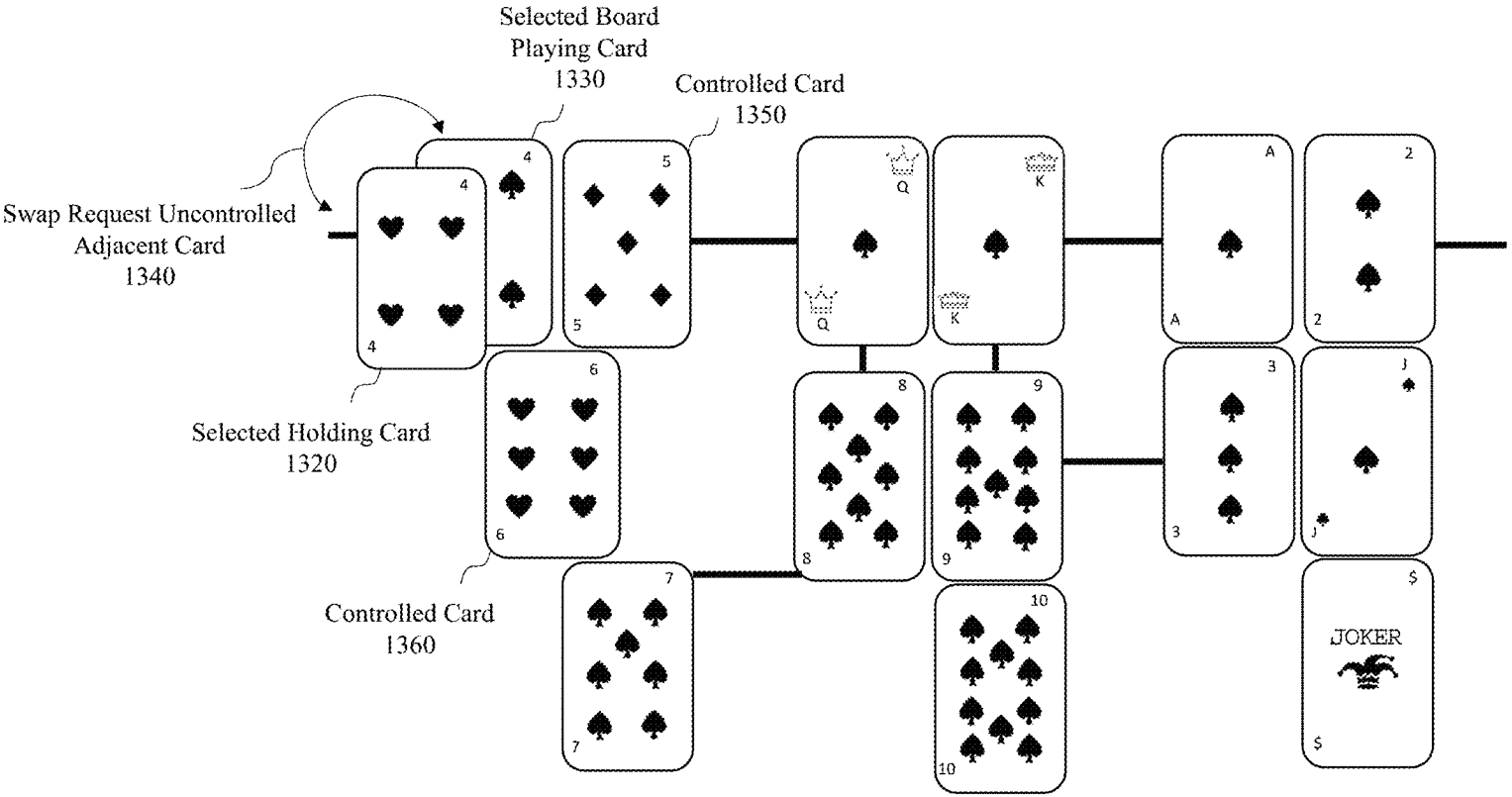
FIG. 13B illustrates the game board after receiving a swap request of an adjacent uncontrolled board playing card, following an alternating turn, according to an example embodiment.

FIG. 13B illustrates the game board after receiving a swap request of an adjacent uncontrolled board playing card, following an alternating turn, according to an example embodiment. The game board displays the selected holding card 1220 of FIG. 12B replaced with the selected board playing card 1230 of FIG. 12B. The selected holding card is now a controlled card 1350 of the second player of the plurality of board playing cards. The game board receives the swap request 1340 from the requesting player, the first player. The requesting player's selected holding card 1320, the four of hearts, is displayed on the game board next to the selected board playing card 1330 depicted as the four of spades. Because this is not the requesting player's first swap request, the selected board playing card must be adjacent to the controlled card of the requesting player, which is the first player. As shown in FIG. 13B, the selected board playing card 1330 is positioned in the first area and includes the third suit not assigned to the first player; therefore, the selected board playing card is an uncontrolled card. The selected board playing card is positioned above the six of hearts; therefore, the selected board playing card is adjacent to the six of hearts. The six of hearts is the controlled card 1360 of the requesting player because it includes the first suit assigned to the requesting player, which is the first player; therefore, swapping the selected board playing card with the selected holding card of the requesting player and adding the selected board playing card to the requesting player's holding cards, then alternating turns.

Figure 14A:
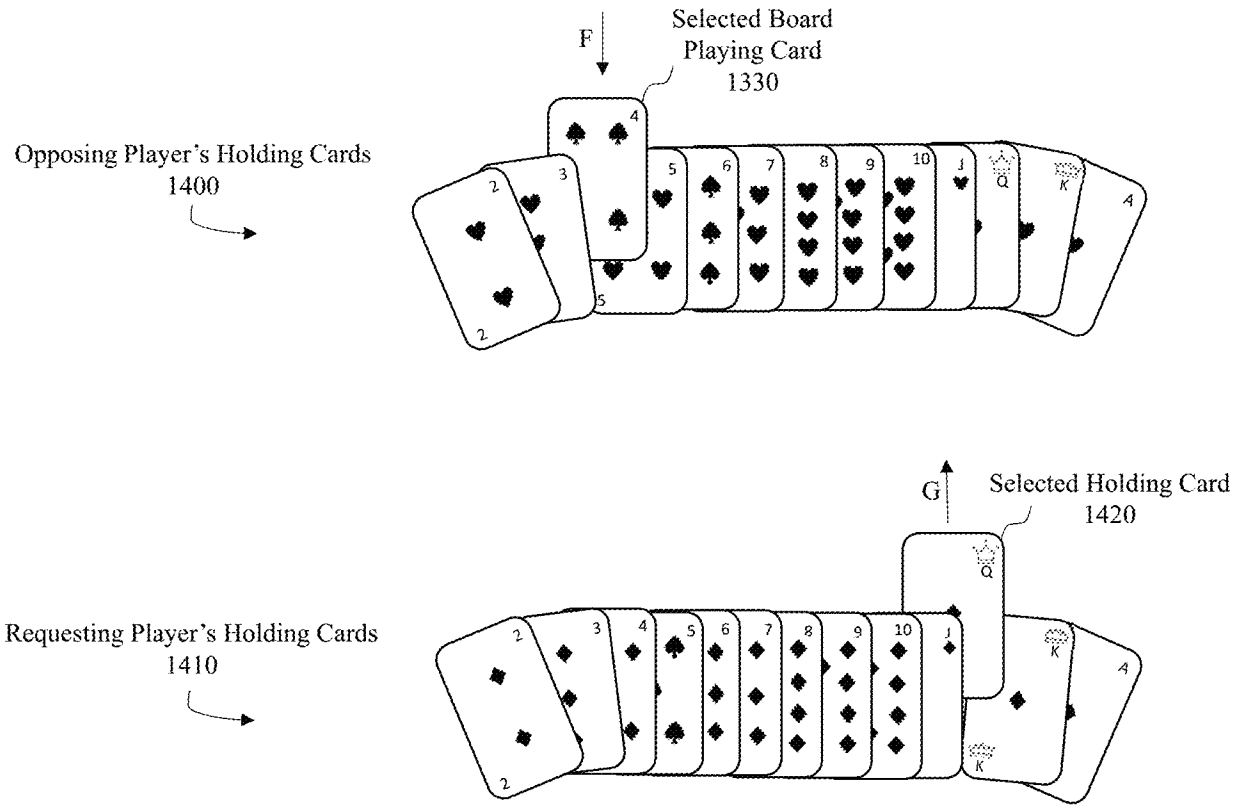
FIG. 14A illustrates the plurality of first player holding cards and second player holding cards after swapping, and alternating turn, according to an example embodiment.

FIG. 14A illustrates the plurality of first player holding cards and second player holding cards after swapping, and alternating turn, according to an example embodiment. The selected board playing card 1330 of FIG. 13B, depicted as the four of spades, is added (line F) to the plurality of first player holding cards, depicted as the opposing player's holding cards 1400 as illustrated in FIG. 14A. It is important to note that the selected board playing card 1330 is added to the requesting player's holding cards, which was the first player when the request was made. The plurality of first player holding cards is depicted as the opposing player's holding cards because FIG. 14A is displaying the plurality of first player holding cards after the first player alternated turns with the second player. After alternating turns, the first player becomes the opposing player and the second player now becomes the requesting player. The second player, now the requesting player, selects (line G) a selected holding card 1420 from the requesting player's holding cards 1410 to send to a swap request to the game board. The selected holding card is depicted as the queen of diamonds. In one embodiment, the server 102 transmitting, with the processor, adding (line F) the selected board playing card to the requesting player's holding cards if the processor determines that information sent in the request that corresponds to the selected board playing card is also adjacent to at least one of the requesting player's controlled cards.

Figure 14B:
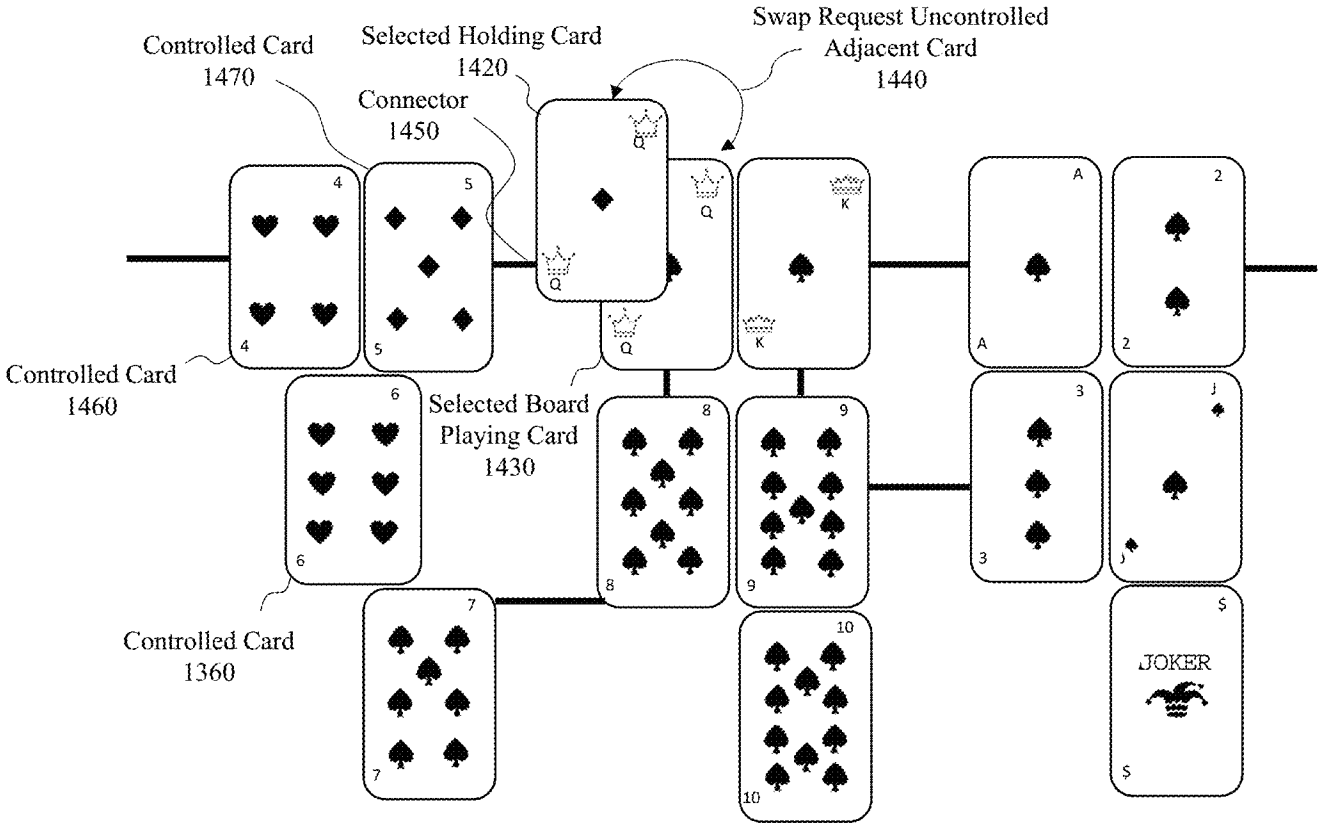
FIG. 14B illustrates the game board after receiving a swap request of an uncontrolled board playing card adjacent to the requesting player's controlled card via a connector, following an alternating turn, according to an example embodiment.

FIG. 14B illustrates the game board after receiving a swap request 1440 of an uncontrolled board playing card adjacent to the requesting player's controlled card via a connector, following an alternating turn, according to an example embodiment. The game board displays the selected holding card 1320 of FIG. 13B replaced with the selected board playing card 1330 of FIG. 13B. The selected holding card is now a controlled card 1460 of the first player of the plurality of board playing cards. The game board receives the swap request 1440 from the requesting player, the second player. The requesting player's selected holding card 1420, the queen of diamonds, is displayed on the game board next to the selected board playing card 1430 depicted as the queen of spades. Because this is not the requesting player's first swap request, the selected board playing card must be adjacent to the controlled card of the requesting player, which is the second player. As shown in FIG. 14B, the selected board playing card is positioned in the second area 424 of FIG. 4A and includes the third suit 840 of FIG. 8 not assigned to the second player; therefore, the selected board playing card is an uncontrolled card. The selected board playing card is connected via the connector 1450 which is the first connector 615 further detailed above in FIG. 6, to the five of diamonds; therefore, the selected board playing card is adjacent to the five of diamonds. The five of diamonds is the controlled card 1470 of the requesting player because it includes the second suit assigned to the requesting player, which is the second player; therefore, swapping the selected board playing card with the selected holding card of the requesting player and adding the selected board playing card to the requesting player's holding cards, then alternating turns.

Figure 15A:
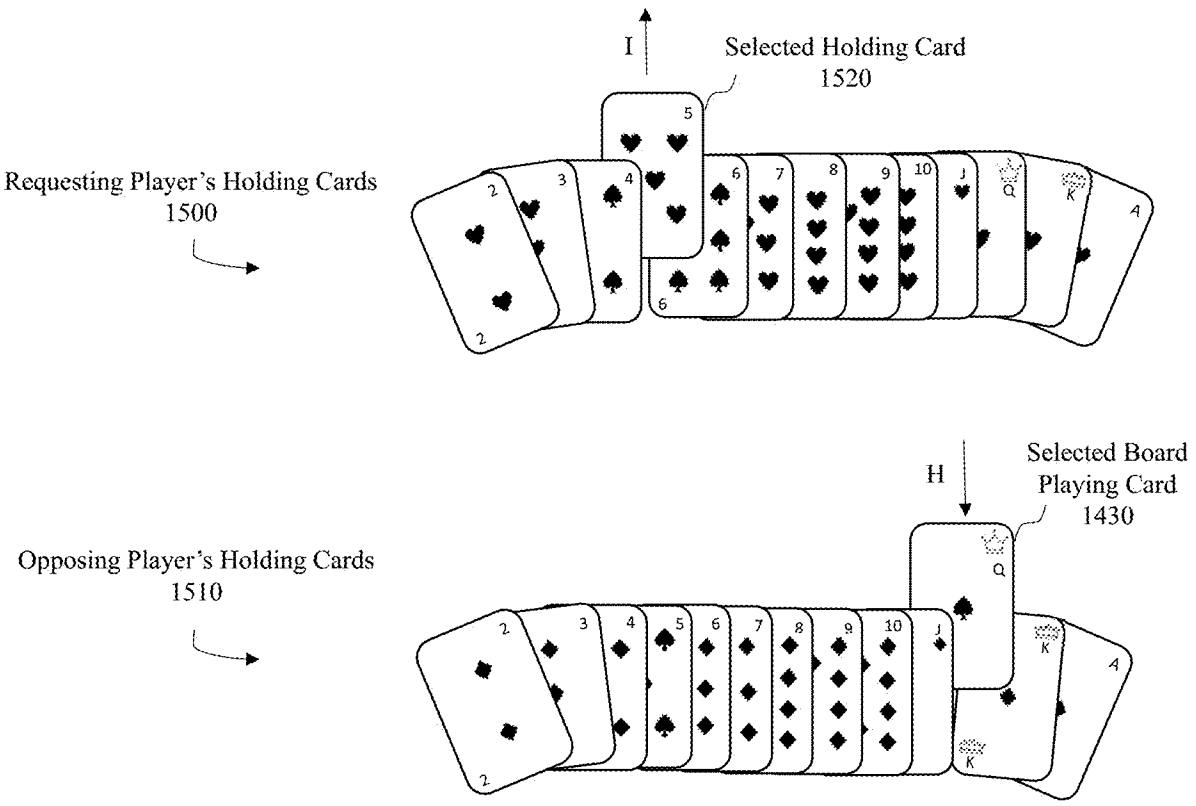
FIG. 15A illustrates the plurality of first player holding cards and second player holding cards after swapping, and alternating turns, according to an example embodiment.

FIG. 15A illustrates the plurality of first player holding cards and second player holding cards after swapping, and alternating turns, according to an example embodiment. The selected board playing card 1430 of FIG. 14B, depicted as the queen of spades, is added (line H) to the plurality of second player holding cards depicted as the opposing player's holding cards 1510 as illustrated in FIG. 15A. It is important to note that the selected board playing card 1430 is added to the requesting player's holding cards, which was the second player when the request was made. The plurality of second player holding cards is depicted as the opposing player's holding cards because FIG. 15A is displaying the plurality second player holding cards after the second player alternated turns with the first player. After alternating turns, the first player becomes the requesting player and the second player now becomes the opposing player. The first player, now the requesting player, selects (line I) a selected holding card 1520 from the requesting player's holding cards 1500 to send to a swap request to the game board. The selected holding card is depicted as the five of hearts.

Figure 15B:
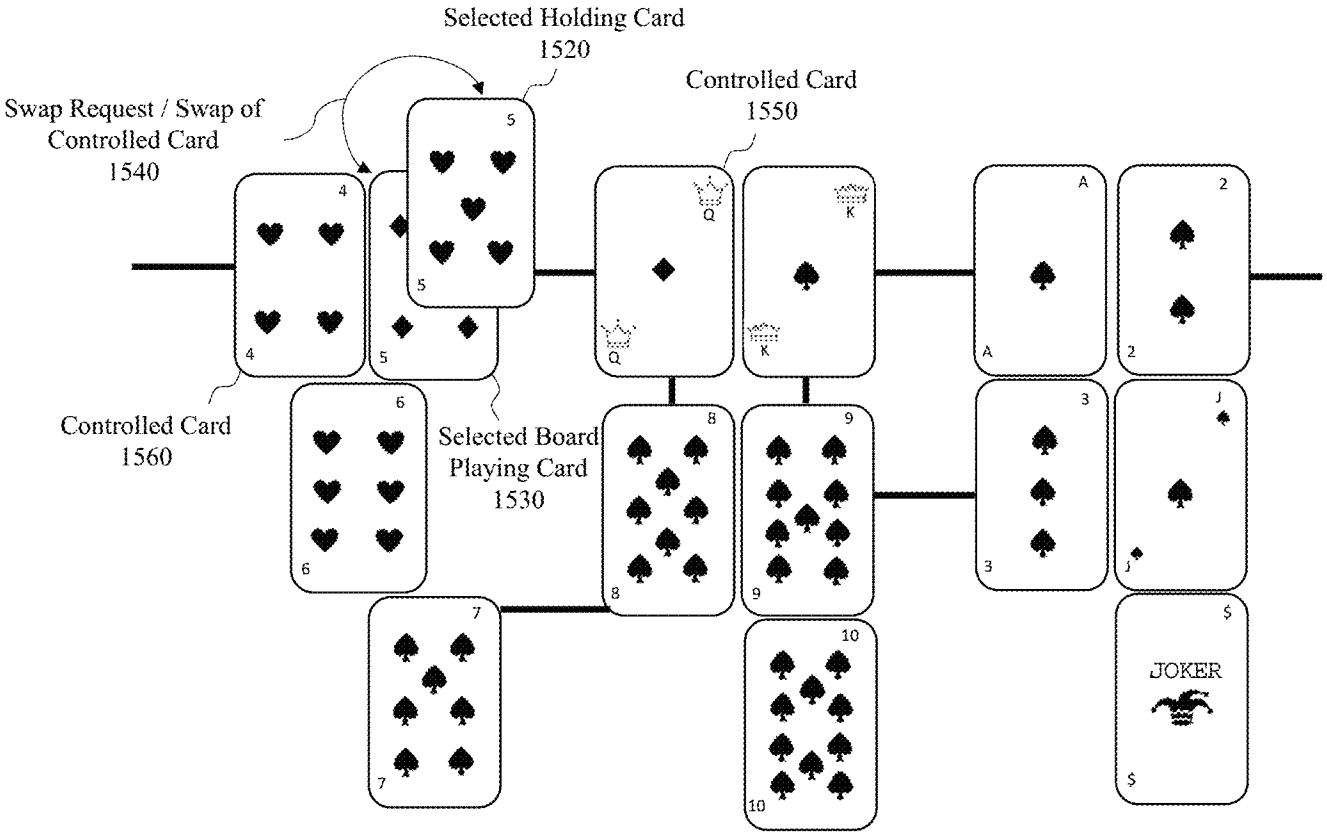
FIG. 15B illustrates the game board after receiving a swap request of an adjacent opposing player's controlled card, following an alternating turn, according to an example embodiment.

FIG. 15B illustrates the game board after receiving a swap request 1540 of an adjacent opposing player's controlled card, following an alternating turn, according to an example embodiment. The game board displays the selected holding card 1420 of FIG. 14B replaced with the selected board playing card 1430 of FIG. 14B. The selected holding card is now a controlled card 1550 of the second player of the plurality of board playing cards. The game board receives the swap request from the requesting player, the first player. The requesting player's selected holding card 1520, the five of hearts, is displayed on the game board next to the selected board playing card 1530 depicted as the five of diamonds. Because this is not the requesting player's first swap request, the selected board playing card must be adjacent to the controlled card of the requesting player, which is the first player. As shown in FIG. 15B, the selected board playing card is positioned in the second area and does not include the third suit. The selected board playing card includes the second suit assigned to the opposing player, which is the second player; therefore, the selected board playing card is a controlled card of the opposing player, specifically the controlled card 1470 as illustrated in FIG. 14B. The selected board playing card is positioned to the right of the four of hearts, therefore the selected board playing card is adjacent to the four of hearts. The four of hearts is the controlled card 1560 of the requesting player because it includes the first suit assigned to the requesting player, which is the first player. Because the selected board playing card is the controlled card of the opposing player, the requesting player and the opposing player must battle, as illustrated in FIGS. 16A-16D.

Figure 16A:
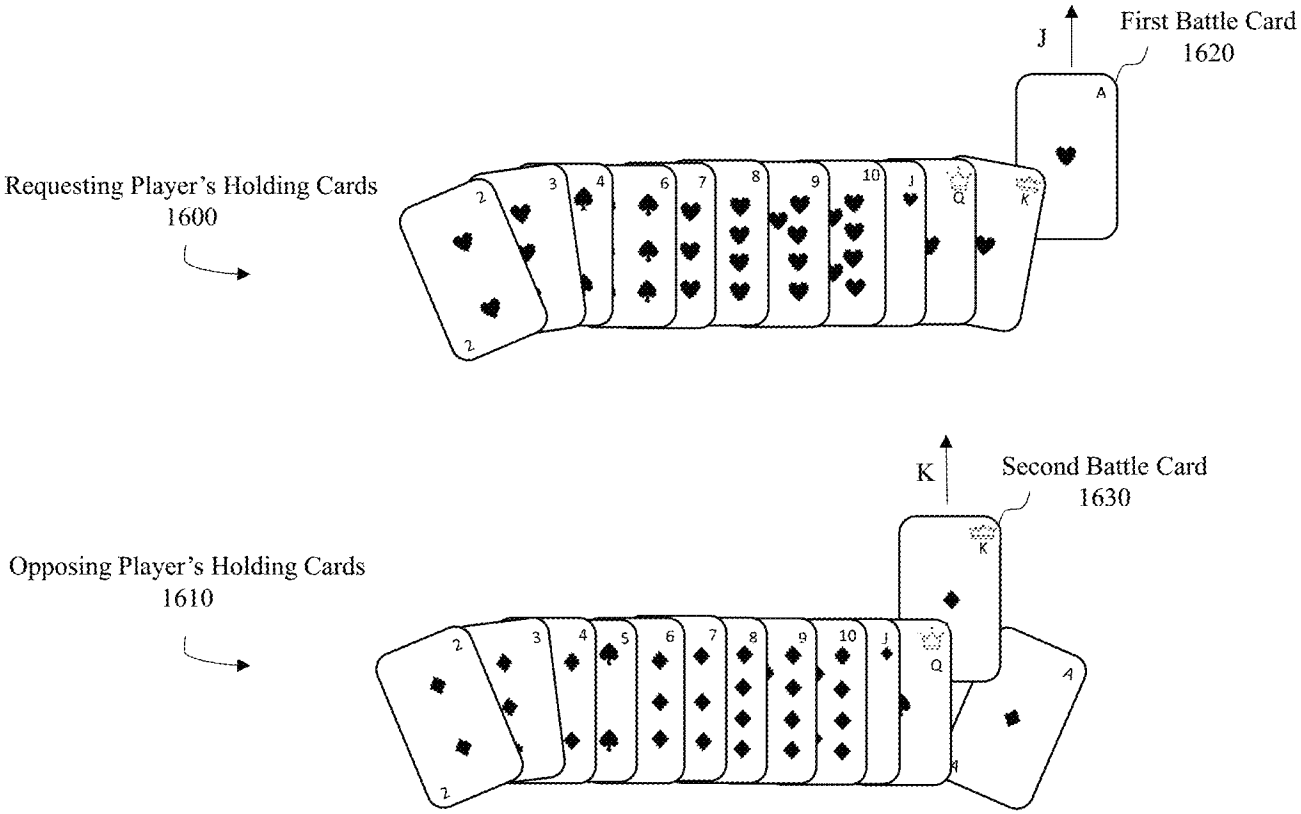
FIG. 16A illustrates selecting a first battle card of the requesting player from the requesting player's holding cards and a second battle card of the opposing player from the opposing player's holding cards, according to an example embodiment.

FIG. 16A illustrates selecting (line J) a first battle card 1620 of the requesting player from the requesting player's holding cards 1600 and selecting (line K) a second battle card 1630 of the opposing player from the opposing player's holding cards 1610, according to an example embodiment. The first battle card of the requesting player was randomly selected (line J) pursuant to methods consistent with this disclosure. The first battle card is depicted as the ace of hearts. The second battle card of the opposing player was randomly selected (line K) pursuant to methods consistent with this disclosure. The second battle card is depicted as the king of diamonds. Randomly selecting a battle card may include shuffling one of the requesting player's holding cards and opposing player's holding cards, then burning or removing at least one holding card and selecting the next holding card as one of the first battle card and second battle card, respectively. In one embodiment, the server, via the processor, may randomize one of the plurality of requesting player's holding cards and plurality of opposing player's holding cards via a randomization algorithm, and display the plurality of randomized holding cards on one of the requesting player's computing device and opposing player's computing device, where the requesting player's computing device and opposing layer's computing device is each one of the first computing device and second computing device of system 100 as illustrated in FIG. 1.

Figure 16B:
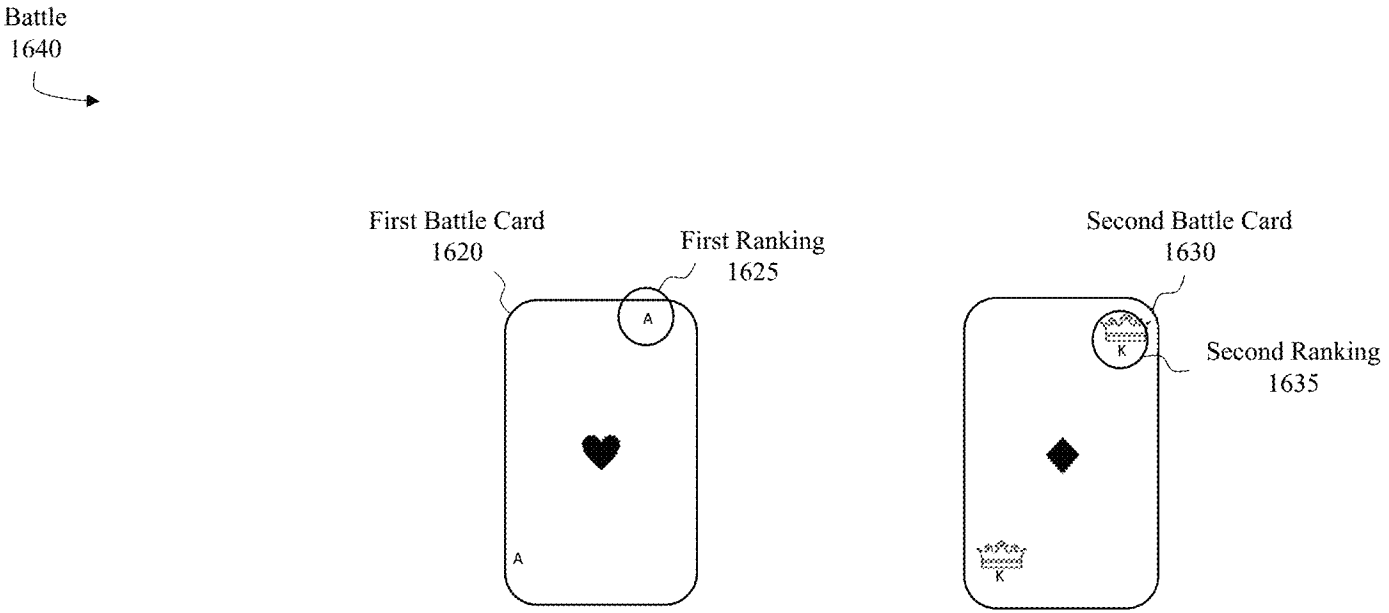
FIG. 16B illustrates a battle between the first battle card of the requesting player and the second battle card of an opposing player, according to an example embodiment.
Figure 16C:
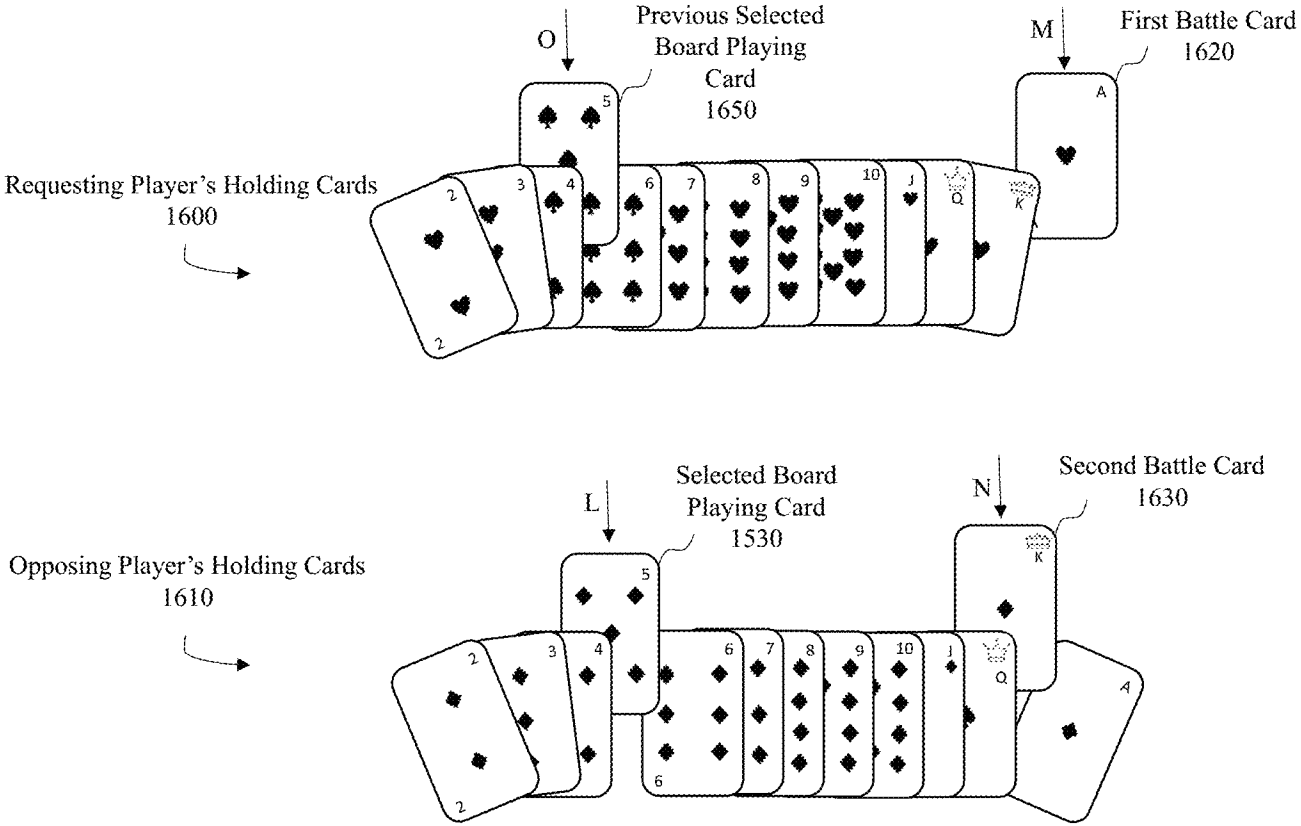
FIG. 16C illustrates the plurality of first player holding cards and the plurality of second player holding cards following the requesting player winning the battle, according to an example embodiment.

FIG. 16B illustrates a battle 1640 between the first battle card 1620 of the requesting player and the second battle card 1630 of an opposing player, according to an example embodiment. The first battle card and second battle card are displayed to the first player and second player. The first battle card and the second battle may be displayed on at least one of the display 142, on the first computing device 112, and second computing device 122. The first battle card and second battle card may also be displayed on the graphical representation of the game board. After the first battle card and the second battle card are displayed, determining whether the first battle card has a ranking greater than that of the second battle card. In this example embodiment, it was predetermined that the ranking of the cards obtained a value from lowest to highest according to the value on playing card, where two is the lowest vale card and ace is the highest value card. As shown in FIG. 16B, the first battle card depicted as an ace has a first ranking 1625 greater than the second ranking 1635 of second battle card depicted as the king of diamonds. Therefore, replacing the selected board playing card with the selected holding card of the requesting player, adding the selected board playing card to the holding cards of the of the opposing player; and adding the first battle card of the requesting player to the requesting player's holding cards and adding the second battle card of the opposing player to the opposing player's holding cards, as illustrated in FIG. 16C. In one embodiment, the server 102 transmitting, with the processor, to at least one of the requesting player computing device and opposing player computing device, information corresponding to having displayed both the first battle card randomly selected from the requesting player's holding cards and the second battle card randomly selected from the opposing player's holding cards if the processor determines that information sent in the swap request that corresponds to that the selected board playing card is one of the opposing player's controlled cards.

FIG. 16C illustrates the plurality of first player holding cards and the plurality of second player holding cards following the requesting player winning the battle, according to an example embodiment. Following displaying the first battle card 1620 of FIG. 16B and the second battle card 1630 of FIG. 16B, declaring the requesting player a battle winner because the first battle card has a greater ranking than the second battle card. As shown in FIG. 16C, adding (line L) the selected board playing card 1530 of FIG. 15B to the opposing player's holding cards 1610; and adding (line M) the first battle card 1620 of the requesting player to the requesting player's holding cards 1600 and adding (line N) the second battle card 1630 of the opposing player to the opposing player's holding cards 1610. In the example embodiment FIG. 16B, the five of spades, which was selected board playing card 1230 as shown in FIG. 12B and was added (line O) to the holding cards of opposing player 1310 as shown in FIG. 13A was added to the requesting player's holding cards 1600 when the requesting player was declared a battle winner and the selected board playing card 1530, depicted as the five of diamonds, was added to the opposing player's holding cards 1610. The selected board playing card 1230 of FIG. 12B is depicting in FIG. 16C as a previous selected board playing card 1650. In one embodiment, the plurality of first player holding cards cannot include both a first holding card including the first suit and a second holding card including the third suit if the respective holding cards are equivalent in ranking. In one embodiment, the plurality of second player holding cards cannot include both a first holding card including the second suit and a second holding card including the third suit if the respective holding cards are equivalent in ranking. For example, the plurality of first player holding cards cannot include both a seven of spades and a seven of diamonds; likewise, the plurality of second player holding cards cannot include both a five of spades and a five of diamonds.

Figure 16D:
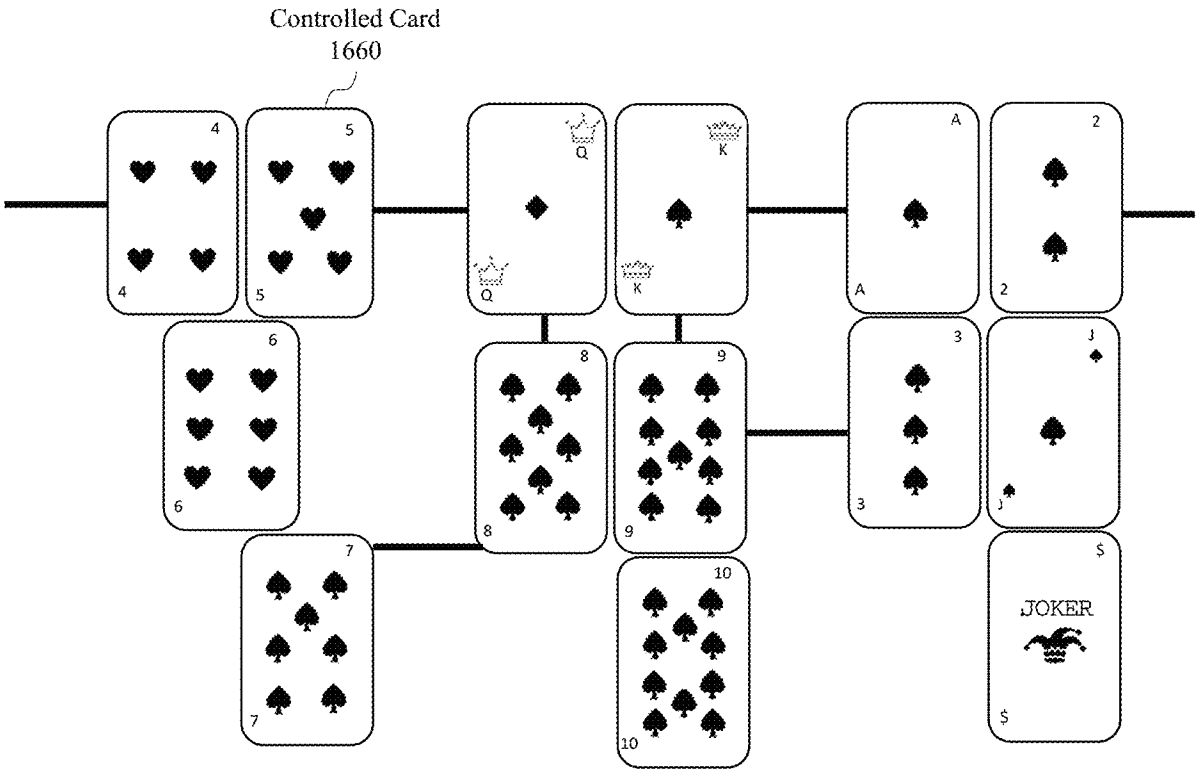
FIG. 16D illustrates the game board after the requesting player wins the battle, according to an example embodiment.

FIG. 16D illustrates the game board after the requesting player wins the battle 1640, according to an example embodiment. The game board displays replacing the selected board playing card 1530 of FIG. 15B with the selected holding card 1520 of FIG. 5B of the requesting player. The selected holding card is now a controlled card 1660 of the first player of the plurality of board playing cards.

In one embodiment, if the first battle card had a ranking equal to the ranking of the second battle card, then displaying the embodiments of FIGS. 16A-16D, until one of the first battle card having a ranking greater than the second battle card, and the second battle card having a ranking greater than the second battle card. For example, referring back to FIG. 16B, if first battle card 1620 included a first ranking 1625 including the seven of hearts and the second battle card 1630 included a second ranking 1635 including the seven of diamonds, then the first ranking and the second ranking would be equivalent in value according to the predetermined ranking; therefore declaring a battle tie. A battle resulting in a battle tie, the requesting player may, again, select a first battle card 1620 from the requesting player's holding cards where the first battle card includes a third battle card and the opposing player selects a second battle card 1630 where the second battle card includes a fourth battle card.

Figure 17:
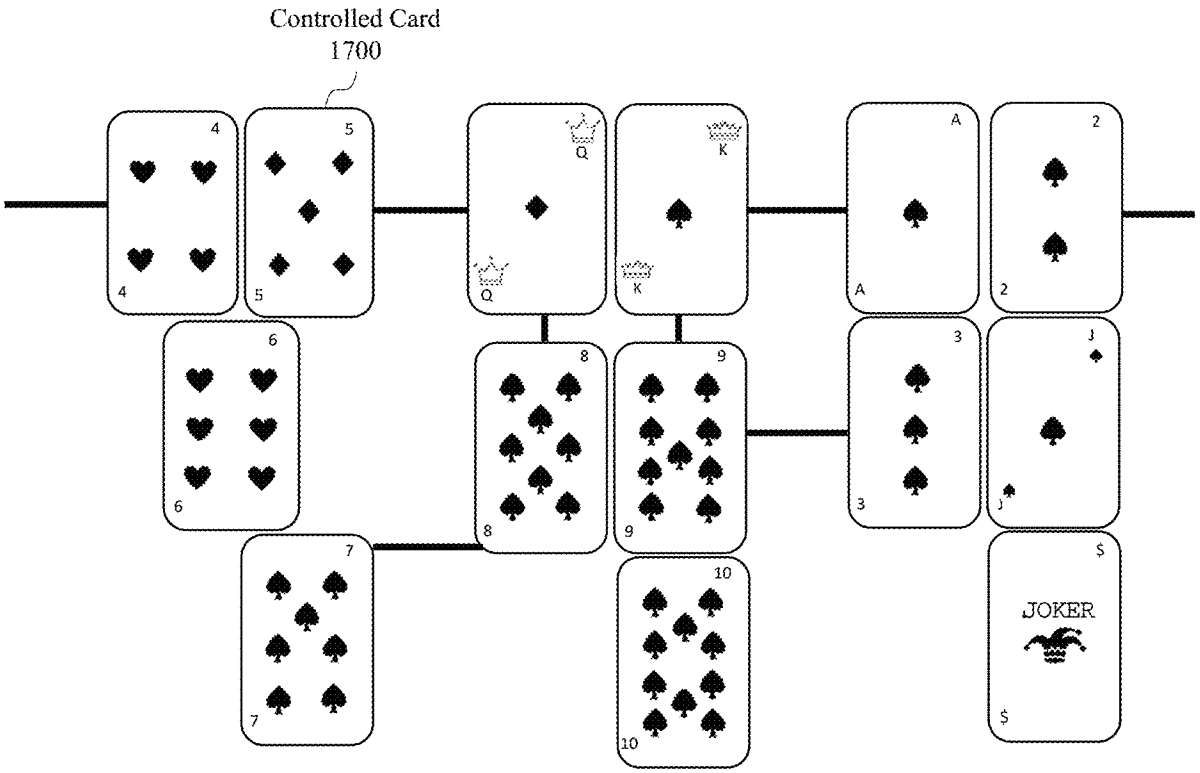
FIG. 17 illustrates the game board after the requesting player loses the battle, according to an example embodiment.

FIG. 17 illustrates the game board after the requesting player loses the battle, according to an example embodiment. The swap request 1540 of FIG. 15B is denied and the selected board playing card 1530 of FIG. 15B is not replaced with the selected holding card 1520 of FIG. 15. The selected board playing card is still the controlled card 1350 of FIG. 13B of the second player depicted in FIG. 17 as controlled card 1700. It is important to note that FIG. 17 is an alternative displayed game board of the outcome of the battle of FIG. 16B if the first battle card 1620 of the requesting player had a ranking less than the second battle card 1630 of the opposing player.

Figure 18A:
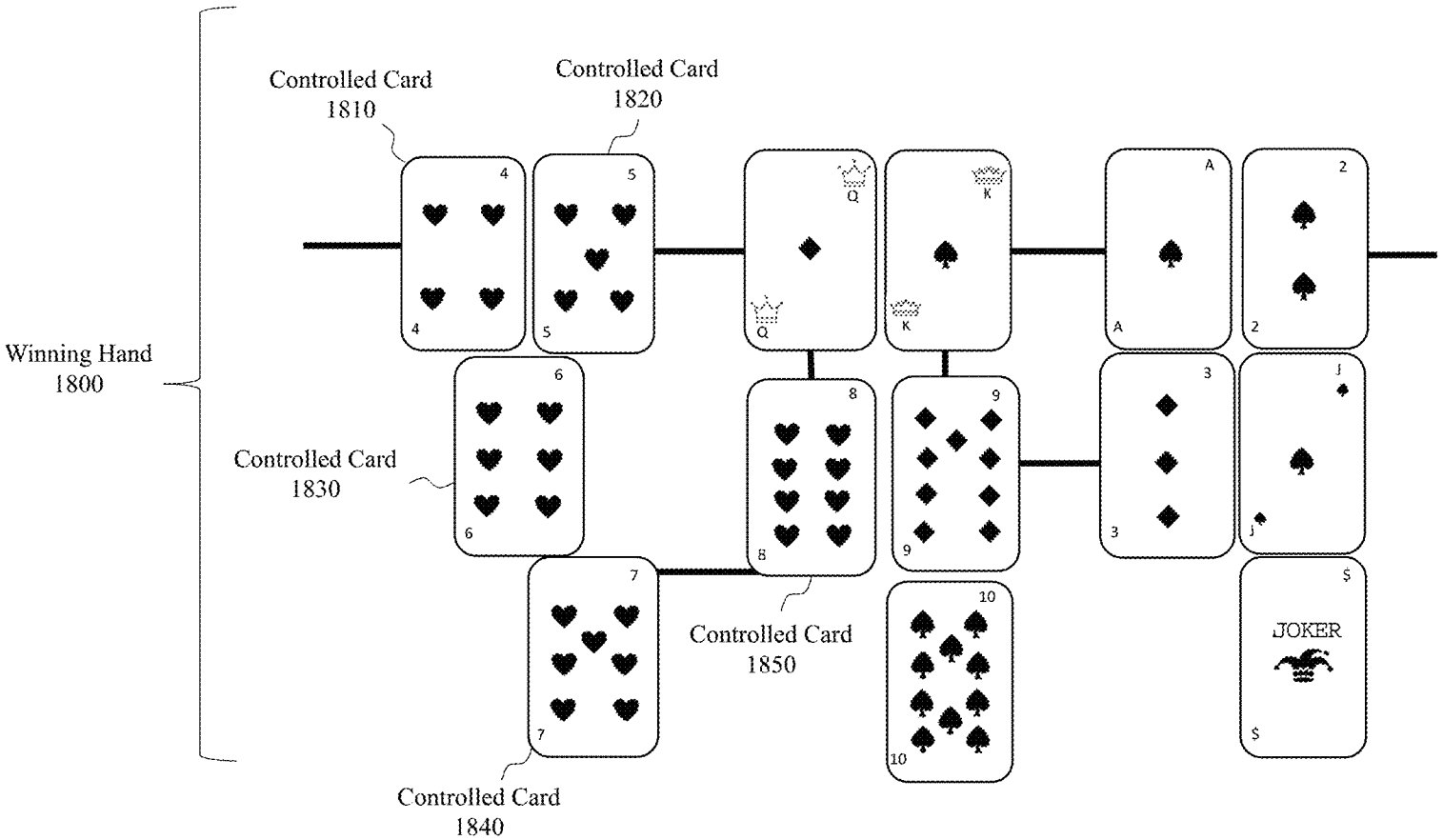
FIG. 18A illustrates the game board including a winning hand, according to an example embodiment.

FIG. 18A illustrates the game board including a winning hand 1800, according to an example embodiment. The transition between FIG. 16D and FIG. 18 includes alternating turns, where each of the first player and second player send swap requests (step 724 of method 700 of FIG. 7C) until one of the first player and second player accumulates a winning hand. As displayed in FIG. 18A, a winning hand may include a straight flush including controlled cards of the plurality of board playing cards. A straight flush includes controlled cards having a sequential ranking. As shown, the first player having controlled cards including the controlled card 1810 depicted as the four of hearts, controlled card 1820 depicted as the five of hearts, controlled card 1830 depicted as the six of hearts, and controlled card 1840 depicted as the seven of hearts in the first area 402 of FIG. 4A, and the adjacent controlled card 1850 depicted as the eight of hearts via the third connector 617 of FIG. 6 in the third area 406 of FIG. 4A.

Figure 18B:
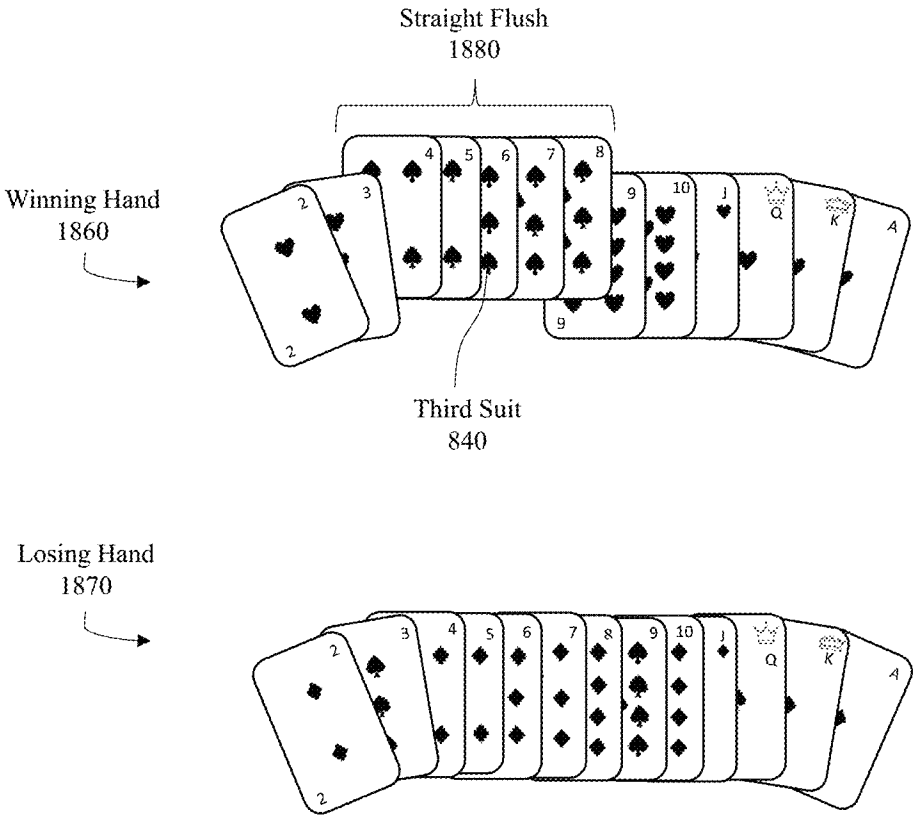
FIG. 18B illustrates the plurality of first player holding cards depicting a winning hand and the plurality of second player holding cards depicting a losing hand, according to an example embodiment.

FIG. 18B illustrates the plurality of first player holding cards depicting a winning hand and the plurality of second player holding cards depicting a losing hand, according to an example embodiment. The plurality of first player holding cards are depicted as a winning hand 1860 and the plurality of second player holding cards are depicted as a losing hand 1870. It is important to note that winning hand is the requesting player's holding cards and the losing hand is the opposing player's holding cards. The winning hand may also include a straight flush 1880 in the requesting player's holding cards. As shown, the straight flush includes holding cards including the third suit 840, shown in FIG. 8, not assigned to the first player. The straight flush includes the four of spades, the five of spades, the six of spades, the seven of spades, and the eight of spades. Also shown are the plurality of second player holding cards. It is important to note that in the example embodiment, the plurality of first player holding cards does not include both a first holding card including the first suit and a second holding card including the third suit where the respective holding cards are equivalent in ranking; and the plurality of second player holding cards does not include both a first holding card including the second suit and a second holding card including the third suit where the respective holding cards are equivalent in ranking. Each of the plurality of first player holding cards and the plurality of second player holding cards includes playing cards ranking from two through ace, without having holding cards of duplicate rankings.

Figure 19:
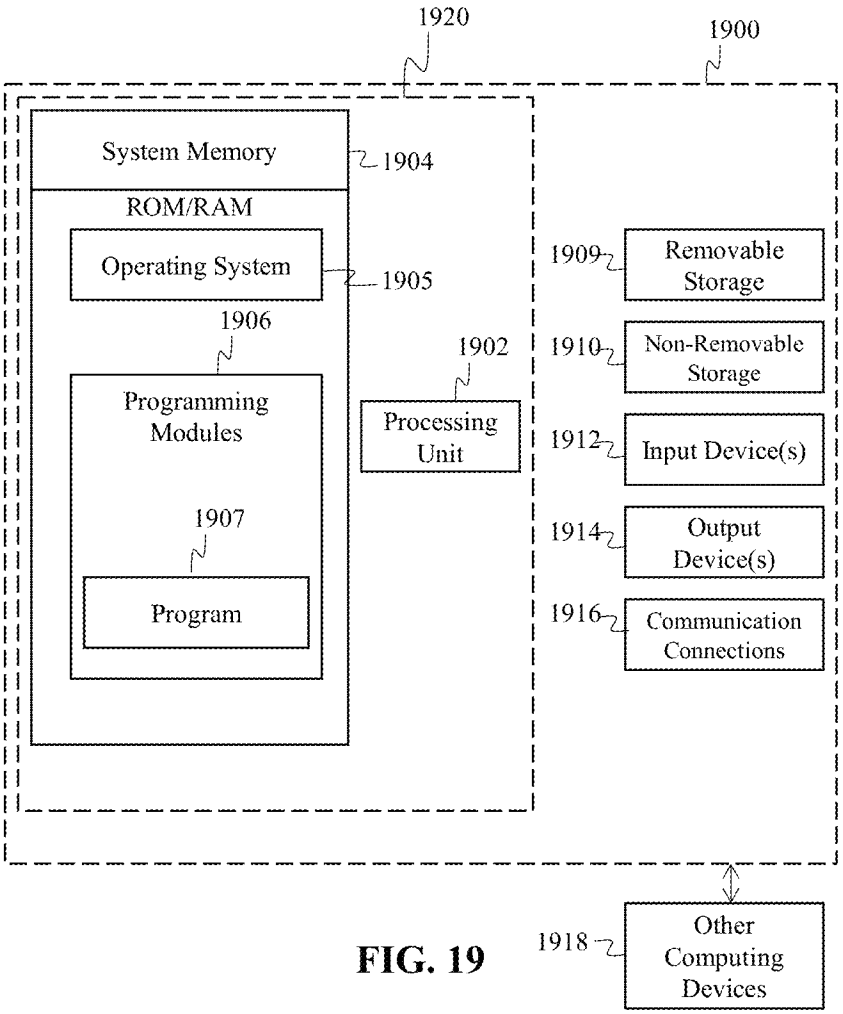
FIG. 19 illustrates a block diagram of a computer system according to exemplary embodiments of the present technology, according to an example embodiment.

Now, with reference now to FIG. 19, a block diagram of a system including an example computing device 1900 and other computing devices is shown. Consistent with the embodiments described herein the aforementioned method 700 and system 100 may be implemented in a computing device, such as the computing device 1900 of FIG. 19. Any suitable combination of hardware, software, or firmware may be used to implement the computing device 1900. The aforementioned system, device, and processors are examples and other systems, devices, and processors may comprise the aforementioned computing device. Furthermore, computing device 1900 may comprise an operating environment for system 100. Processes, data related to system 100 may operate in other environments and are not limited to computing device 1900.

A system consistent with an embodiment of the disclosure may include a plurality of computing devices, such as computing device 1900. In a basic configuration, computing device 1900 may include at least one processing unit 1902 and a system memory 1904. Depending on the configuration and type of computing device, system memory 1904 may comprise, but is not limited to, volatile (e.g. random access memory (RAM)), non-volatile (e.g. read-only memory (ROM)), flash memory, or any combination or memory. System memory 1904 may include operating system 1905, and one or more programming modules 19019. Operating system 1905, for example, may be suitable for controlling computing device 1900's operation. Furthermore, embodiments of the disclosure may be practiced in conjunction with a graphics library, other operating systems, or any other application program and is not limited to any particular application or system. This basic configuration is illustrated in FIG. 19 by those components within a dashed line 1920.

Computing device 1900 may have additional features or functionality. For example, computing device 1900 may also include additional data storage devices (removable and/or non-removable) such as, for example, magnetic disks, optical disks, or tape. Such additional storage is illustrated in FIG. 19 by a removable storage 19019 and a non-removable storage 1910. Computer storage media may include volatile and nonvolatile, removable, and non-removable media implemented in any method or technology for storage of information, such as computer readable instructions, data structures, program modules, or other data. System memory 1904, removable storage 19019, and non-removable storage 1910 are all computer storage media examples (i.e. memory storage.) Computer storage media may include, but is not limited to, RAM, ROM, electrically erasable read-only memory (EEPROM), flash memory or other memory technology, CD-ROM, digital versatile disks (DVD) or other optical storage, magnetic cassettes, magnetic tape, magnetic disk storage or other magnetic storage devices, or any other medium which can be used to store information and which can be accessed by computing device 1900. Any such computer storage media may be part of system 1900. Computing device 1900 may also have input device(s) 1912 such as a keyboard, a mouse, a pen, a sound input device, a camera, a touch input device, etc. Output device(s) 1914 such as a display, speakers, a printer, etc. may also be included. The aforementioned devices are only examples, and other devices may be added or substituted.

Computing device 1900 may also contain a communication connection 1916 that may allow system 100 to communicate with other computing devices 1919, such as over a network in a distributed computing environment, for example, an intranet or the Internet. Communication connection 1916 is one example of communication media. Communication media may typically be embodied by computer readable instructions, data structures, program modules, or other data in a modulated data signal, such as a carrier wave or other transport mechanism, and includes any information delivery media. The term "modulated data signal" may describe a signal that has one or more characteristics set or changed in such a manner as to encode information in the signal. By way of example, and not limitation, communication media may include wired media such as a wired network or direct-wired connection, and wireless media such as acoustic, radio frequency (RF), infrared, and other wireless media. The term computer readable media as used herein may include both computer storage media and communication media.

As stated above, a number of program modules and data files may be stored in system memory 1904, including operating system 1905. While executing on processing unit 1902, programming modules 19019 (e.g. program module 1907) may perform processes including, for example, one or more of the stages of a process. The aforementioned processes are examples, and processing unit 1902 may perform other processes. The aforementioned processes are examples, and processing unit 1902 may perform other processes and may also be configured to provide a graphical representation displayed associated with devices explained above. Other programming modules that may be used in accordance with embodiments of the present disclosure may include electronic mail and contacts applications, word processing applications, spreadsheet applications, database applications, slide presentation applications, drawing or computer-aided application programs, etc.

Generally, consistent with embodiments of the disclosure, program modules may include routines, programs, components, data structures, and other types of structures that may perform particular tasks or that may implement particular abstract data types. Moreover, embodiments of the disclosure may be practiced with other computer system configurations, including hand-held devices, multiprocessor systems, microprocessor-based or programmable consumer electronics, minicomputers, mainframe computers, and the like. Embodiments of the disclosure may also be practiced in distributed computing environments where tasks are performed by remote processing devices that are linked through a communications network. In a distributed computing environment, program modules may be located in both local and remote memory storage devices.

Furthermore, embodiments of the disclosure may be practiced in an electrical circuit including discrete electronic elements, packaged or integrated electronic chips containing logic gates, a circuit utilizing a microprocessor, or on a single chip (such as a System on Chip) containing electronic elements or microprocessors. Embodiments of the disclosure may also be practiced using other technologies capable of performing logical operations such as, for example, AND, OR, and NOT, including but not limited to mechanical, optical, fluidic, and quantum technologies. In addition, embodiments of the disclosure may be practiced within a general-purpose computer or in any other circuits or systems.

Embodiments of the present disclosure, for example, are described above with reference to block diagrams and/or operational illustrations of methods, systems, and computer program products according to embodiments of the disclosure. The functions/acts noted in the blocks may occur out of the order as shown in any flowchart. For example, two blocks shown in succession may in fact be executed substantially concurrently or the blocks may sometimes be executed in the reverse order, depending upon the functionality/acts involved.

While certain embodiments of the disclosure have been described, other embodiments may exist. Furthermore, although embodiments of the present disclosure have been described as being associated with data stored in memory and other storage mediums, data can also be stored on or read from other types of computer-readable media, such as secondary storage devices, like hard disks, floppy disks, or a CD-ROM, or other forms of RAM or ROM. Further, the disclosed methods' stages may be modified in any manner, including by reordering stages, and/or inserting or deleting stages, without departing from the disclosure.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

I claim:

1. A gameboard for a playing card game, wherein the gameboard comprises:

a first area having a first shape comprising a first group of playing cards from a deck of a plurality of playing cards, wherein the first shape defines a first stylized representation of Americas;

a second area having a second shape comprising a second group of playing cards from the deck, wherein the second shape defines a second stylized representation of Europe;

a third area having a third shape comprising a third group of playing cards from the deck, wherein the third shape defines a third stylized representation of Africa;

a fourth area having a fourth shape comprising a fourth group of playing cards from the deck, wherein the fourth shape defines a fourth stylized representation of Asia; and a fifth area having a fifth shape comprising a fifth group of playing cards from the deck, wherein the fifth shape defines a fifth stylized representation of Australia;

a connector that connects at least two adjacent areas, wherein the adjacent areas are one of the first area, second area, third area, fourth area and fifth area.

2. The gameboard of claim 1, wherein the connector further comprises at least one of:

a first connector that connects the second area to the first area;

a second connector that connects the third area to the second area;

a third connector that connects the first area to the third area;

a fourth connector that connects the third area to the second area;

a fifth connector that connects the second area to the fourth area;

a sixth connector that connects the fourth area to the first area; and a seventh connector that connects a three of the first suit in the fourth area to the nine of the first suit in the third area.

3. The gameboard of claim 2 further comprising:

four playing cards within the first group of playing cards;

two playing cards within the second group of playing cards;

three playing cards within the third group of playing cards;

four playing cards within the fourth group of playing cards; and one playing card within the fifth group of playing cards.

4. The gameboard of claim 3 wherein each of the playing cards is of a first suit and wherein each connector comprises at least one of an elongated mark and an elongated structure positioned such that the elongated structure spans between two playing areas of the gameboard.

5. The gameboard of claim 4 further comprising:

wherein the four playing cards in the first area comprise (1) a four of the first suit adjacent to and to the left of (2) the five of the first suit, (3) a six of the first suit adjacent to and below the four of the first suit and the five of the first suit, and (4) a seven of the first suit adjacent to and below the six of the first suit;

wherein the two playing cards in the second area comprise (1) a queen of the first suit adjacent to and to the left of (2) a king of the first suit;

wherein the three playing cards in the third area comprise (1) an eight of the first suit adjacent to and to the left of (2) a nine of the first suit, and (3) a ten of the first suit adjacent and below the nine of the first suit;

wherein the four playing cards in the fourth area comprise (1) an ace of the first suit adjacent to and to the left of (2) a two of the first suit, (3) a three of the first suit below and adjacent to the ace of the first suit, (4) a jack of the first suit below the two of the first suit and adjacent to both the three of the first suit and the two of the first suit; and wherein the one playing card in the fifth area is a joker adjacent to the jack of the first suit.

6. The gameboard of claim 5 further comprising:

wherein the first connector that connects the queen in the second area to the five in the first area;

wherein the second connector that connects the eight of the first suit in the third area to the queen of the first suit in the second area;

wherein the third connector that connects the seven of the first suit in the first area to the eight of the first suit in the third area;

wherein the fourth connector that connects the nine of the first suit in the third area to the king of the first suit in the second area;

wherein the fifth connector that connects the king of the first suit in the second area to the ace of the first suit in the fourth area;

wherein the sixth connector that connects the two of the first suit in the fourth area to the four of the first suit in the first area; and wherein the seventh connector that connects the three of the first suit in the fourth area to the nine of the first suit in the third area.

7. A system for conducting a game using a gameboard to provide an entertaining experience of war between players of a card game wherein the object of the game is to accumulate a straight flush on one of the plurality of areas of the gameboard representing continents or in a player's hand, the system comprising:

a gameboard comprising:

(i) a first area having a first shape comprising a first group of playing card placement areas; wherein the first shape defines a first stylized representation of Americas;

(ii) a second area having a second shape comprising a second group of playing card placement areas; wherein said second shape defines a second stylized representation of Europe;

(iii) a third area having a third shape comprising a third group of playing card placement areas; wherein said third shape defines a third stylized representation of Africa;

(iv) a fourth shape having a fourth area comprising a fourth group of playing card placement areas; wherein said forth shape defines a fourth stylized representation of Asia;

(v) a fifth shape having a fifth area comprising a fifth group of playing card placement areas; wherein said fifth shape defines a fifth stylized representation of Australia;

(vi) a connector that connects at least two adjacent areas, wherein the adjacent areas are one of the first area, second area, third area, forth area and fifth area; and placing (1) a first group of playing cards within the first group of playing card placement areas; (2) a second group of playing cards within the second group of playing card placement areas; (3) a third group of playing cards within the third group of playing card placement areas; (4) a fourth group of playing cards within the fourth group of playing card placement areas; and (5) a fifth group of playing cards within the fifth group of playing card placement areas.

8. The system of claim 7 wherein the connector further comprises at least one of:

a first connector that connects the second area to the first area;

a second connector that connects the third area to the second area;

a third connector that connects the first area to the third area;

a fourth connector that connects the third area to the second area;

a fifth connector that connects the second area to the fourth area;

a sixth connector that connects the fourth area to the first area; and a seventh connector that connects a three of the first suit in the fourth area to the nine of the first suit in the third area.

9. The system of claim 7 wherein placing further comprises:

placing four playing cards within the first group of playing cards;

placing two playing cards within the second group of playing cards;

placing three playing cards within the third group of playing cards;

placing four playing cards within the fourth group of playing cards; and placing one playing card within the fifth group of playing cards.

10. The system of claim 9 further comprising:

wherein the four playing cards in the first area comprise (1) a four of a first suit adjacent to and to the left of (2) the five of the first suit, (3) a six of the first suit adjacent to and below the four of the first suit and the five of the first suit, and (4) a seven of the first suit adjacent to and below the six of the first suit;

wherein the two playing cards in the second area comprise (1) a queen of the first suit adjacent to and to the left of (2) a king of the first suit;

wherein the three playing cards in the third area comprise (1) an eight of the first suit adjacent to and to the left of (2)*a* nine of the first suit, and (3) a ten of the first suit adjacent and below the nine of the first suit;

wherein the four playing cards in the fourth area comprise (1) an ace of the first suit adjacent to and to the left of (2) a two of the first suit, (3) a three of the first suit below and adjacent to the ace of the first suit, (4) a jack of the first suit below the two of the first suit and adjacent to both the three of the first suit and the two of the first suit; and wherein the one playing card in the fifth area is a joker adjacent to the jack of the first suit.

11. The system of claim 10 further comprising:

wherein the first connector that connects the queen in the second area to the five in the first area;

wherein the second connector that connects the eight of the first suit in the third area to the queen of the first suit in the second area;

wherein the third connector that connects the seven of the first suit in the first area to the eight of the first suit in the third area;

wherein the fourth connector that connects the nine of the first suit in the third area to the king of the first suit in the second area;

wherein the fifth connector that connects the king of the first suit in the second area to the ace of the first suit in the fourth area;

wherein the sixth connector that connects the two of the first suit in the fourth area to the four of the first suit in the first area; and wherein the seventh connector that connects the three of the first suit in the fourth area to the nine of the first suit in the third area.

12. The system of claim 11, wherein each connector comprises at least one of an elongated mark and an elongated structure positioned such that the elongated structure spans between two playing areas of the game board.

13. The system of claim 7, further comprising:

a. dealing a first player a plurality of first player holding cards that are all a first suit of a deck of playing cards, wherein only the first suit is assigned to the first player;

b. dealing a second player a plurality of second player holding cards that are all a second suit of the deck, wherein only the second suit is assigned to the second player;

c. displaying the gameboard to the first player and the second player, the gameboard comprising a plurality of board playing cards of the deck of playing cards, and wherein the plurality of board playing cards;

d. receiving a swap request from a requesting player, wherein the requesting player is one of the first player and the second player, to swap a selected holding card from one of a requesting player's holding cards with a selected board playing card of one of the plurality of board playing cards;

e. after receiving the swap request, swapping the selected holding card with the selected board playing card if the selected board playing card is an uncontrolled card, wherein the uncontrolled card comprises a third suit and wherein the controlled card of the requesting player comprises the suit assigned to the requesting player;

f. after receiving the swap request, if the selected board playing card is an opposing player's controlled card, wherein the opposing player is one of the first player and second player that is not the requesting player, then having displayed from both a first battle card of the requesting player and a second battle card of the opposing player wherein the first battle card is randomly selected from the requesting player's holding cards and the second battle card is randomly selected from an opposing player's holding cards;

g. after the first battle card of the requesting player and the second battle card of the opposing player are displayed, determining that the requesting player is a battle winner if the first battle card of the requesting player card has the ranking greater than the second battle card of the opposing player and 1) replacing the selected board playing card of the requesting player with the selected holding card of the requesting player, 2) adding the selected board playing card to the opposing player's holding cards; and, 3) adding the first battle card of the requesting player to the requesting player's holding cards and adding the second battle card of the opposing player to the opposing player's holding cards;

h. after the first battle card of the requesting player and the second battle card of the opposing player are displayed, determining the requesting player is a battle loser if the second battle card of the opposing player has the ranking greater than the first battle card of the requesting player and 1) not replacing the selected board playing card with the selected holding card of the requesting player, and 2) adding the first battle card of the requesting player to the requesting player's holding cards and adding the second battle card of the opposing player to the opposing player's holding cards; and j. wherein the first player and second player alternate turns for sending swap requests until one of the first player and second player accumulates a winning hand to win the card game.

14. The system of claim 13, wherein, after receiving the first battle card of the requesting player and the second battle card of the opposing player, determining a battle tie between the requesting player and opposing player if the second battle card of the opposing player has the ranking equal to the ranking of first battle card of the requesting player and performing at least one of the following:

1) having displayed both a third battle card of the requesting player and a fourth battle card of the opposing player wherein the third battle card is randomly selected from the requesting player's holding cards and the fourth battle card is randomly selected from the opposing player's holding cards for determining the battle winner;

2) determining that the requesting player is the battle winner and performing steps g.(1), g.(2) and g.(3) from claim 13; and 3) determining that the requesting player is the battle loser and performing steps h. 1) and 2) from claim 13.

15. The system of claim 13, wherein before receiving the swap requests from one of the requesting player and the opposing player, all the plurality of board playing cards positioned are uncontrolled cards.

16. The system of claim 13, wherein the system further comprises, before receiving any of the swap requests, determining which of one of the first player and second player to send a first swap request by determining a starting battle winner comprising:

having a first player starting battle card randomly selected from the plurality of first player holding cards;

having a second player starting battle card randomly selected from the plurality of second player holding cards; and selecting a starting battle winner between the first player starting battle card and second player starting battle card, wherein the starting battle winner is one of the first player having a first player starting battle card having a ranking greater than the second player starting battle card and the second player having a second player starting battle card having a greater ranking than the first player starting battle card.

17. A computed implemented method, executed by a processor on a non-transitory recording medium, for executing a game, wherein the computer implemented method outputs a graphical user interface for increasing interactions between a first player and a second player on a gameboard such that the computer implemented method provides an entertaining experience of a strategic playing card game between the first player and the second player, wherein the computer implemented method comprises:

a. providing a graphical user interface comprising a gameboard, wherein the gameboard comprises:

(i) a first area having a first shape comprising a first group of playing cards from a deck of a plurality of playing cards, wherein the first shape defines a first stylized representation of Americas;

(ii) a second area having a second shape comprising a second group of playing cards from the deck, wherein the second shape defines a second stylized representation of Europe;

(iii) a third area having a third shape comprising a third group of playing cards from the deck, wherein the third shape defines a third stylized representation of Africa;

(iv) a fourth area having a fourth shape comprising a fourth group of playing cards from the deck, wherein the fourth shape defines a fourth stylized representation of Asia;

(v) a fifth area having a fifth shape comprising a fifth group of playing cards from the deck, wherein the fifth shape defines a fifth stylized representation of Australia;

(vi) a first connector that connects the second area to the first area;

(vii) a second connector that connects the third area to the second area;

(viii) a third connector that connects the first area to the third area;

(ix) a fourth connector that connects the third area to the second area;

(x) a fifth connector that connects the second area to the fourth area;

(xi) a sixth connector that connects the fourth area to the first area; and (xii) a seventh connector that connects a three of the first suit in the fourth area to the nine of the first suit in the third area;

b. transmitting, by the processor, to at least one of a first computing device and a second computing device, information corresponding to a plurality of first player holding cards are all a first suit of a deck of playing cards, wherein only the first suit is assigned to the first player, and wherein the first computing device comprises a first display and wherein the second computing device comprises a second display;

c. transmitting, by the processor, to at least one of a first computing device and a second computing device, information corresponding to a plurality of second player holding cards, wherein the second player holding cards are all a second suit of the deck of playing cards, wherein only the second suit is assigned to the second player;

d. transmitting, by the processor, to at least one of a first computing device and a second computing device, information corresponding to a plurality of board playing cards from the deck of playing cards defining a plurality of areas to be displayed on at least one of a first display and a second display;

e. receiving, from at least one of a first computing device and second computing device, information corresponding to a swap request from a requesting player, wherein the requesting player device is one of the first player computing device and second player computing device, to swap a selected holding card from one of a requesting player's holding cards with a selected board playing card of one of the plurality of board playing cards;

f. after receiving the swap request, determining, with the processor, if information sent in the request corresponds to that the selected board playing card is at least one of 1) an uncontrolled card, 2) one of an opposing player's controlled cards, wherein the opposing player is one of the first player and second player that is not the requesting player and wherein the opposing player has an opposing player computing device that is one of the first player computing device and second player computing device, 3) one of a requesting player's controlled cards, wherein the uncontrolled card comprises a third suit, wherein the opposing player's controlled card comprises the suit assigned to the opposing player, and wherein the requesting player's controlled card comprises the suit assigned to the requesting player;

g. if the processor determines that information sent in the swap request that corresponds to the selected board playing card is one of the uncontrolled cards, then transmitting, with the processor, to at least one of the requesting player computing device and opposing player computing device, information corresponding to 1) displaying the selected holding card wherein the selected board playing card was positioned on the game board before the swap request was received and 2) adding the selected board playing card to the requesting player's holding cards;

h. if the processor determines that information sent in the swap request that corresponds to the selected board playing card is one of the opposing player's controlled cards, then transmitting, with the processor, to at least one of the requesting player computing device and opposing player computing device, information corresponding to having displayed both a first battle card randomly selected from the requesting player's holding cards and a second battle card randomly selected from the opposing player's holding cards;

i. after the first battle card of the requesting player and the second battle card of the opposing player are selected, determining with the processor that the requesting player is a battle winner when information corresponding to the first battle card of the requesting player has a ranking greater than the second battle card of the opposing player, and sending to least one of requesting player computing device and opposing player computing device information corresponding to 1) replacing the selected board playing card with the selected holding card of the requesting player, 2) adding the selected board playing card to the opposing player's holding cards; and, 3) adding the first battle card of the requesting player to the requesting player's holding cards and adding the second battle card of the opposing player to the opposing player's holding cards;

j. after both the first battle card of the requesting player and the second battle card of the opposing player are displayed, determining with the processor that that opposing player is the battle winner when information corresponding to the second battle card of the opposing player has the ranking greater than the first battle card of the requesting player and sending to least one of requesting player computing device and opposing player computing device information corresponding to 1) not replacing the selected board playing card with the selected holding card, and 2) adding the first battle card of the requesting player to the requesting player's holding cards and adding the second battle card of the opposing player to the opposing player's holding cards; and k. wherein the first player and second player alternate turns for sending swap requests until the processor determines information corresponding to that one of the first player and second player accumulates a winning hand.

18. The computer implemented method of claim 17 further comprising:

four playing cards within the first group of playing cards;

two playing cards within the second group of playing cards;

three playing cards within the third group of playing cards;

four playing cards within the fourth group of playing cards;

one playing card within the fifth group of playing cards;

wherein the four playing cards in the first area comprise (1) a four of the first suit adjacent to and to the left of (2) the five of the first suit, (3) a six of the first suit adjacent to and below the four of the first suit and the five of the first suit, and (4) a seven of the first suit adjacent to and below the six of the first suit;

wherein the two playing cards in the second area comprise (1) a queen of the first suit adjacent to and to the left of (2) a king of the first suit;

wherein the three playing cards in the third area comprise (1) an eight of the first suit adjacent to and to the left of (2) a nine of the first suit, and (3) a ten of the first suit adjacent and below the nine of the first suit;

wherein the four playing cards in the fourth area comprise (1) an ace of the first suit adjacent to and to the left of (2) a two of the first suit, (3) a three of the first suit below and adjacent to the ace of the first suit, (4) a jack of the first suit below the two of the first suit and adjacent to both the three of the first suit and the two of the first suit; and wherein the one playing card in the fifth area is a joker adjacent to the jack of the first suit.

19. The computer implemented method of claim 18 further comprising:

wherein the first connector that connects the queen in the second area to the five in the first area;

wherein the second connector that connects the eight of the first suit in the third area to the queen of the first suit in the second area;

wherein the third connector that connects the seven of the first suit in the first area to the eight of the first suit in the third area;

wherein the fourth connector that connects the nine of the first suit in the third area to the king of the first suit in the second area;

wherein the fifth connector that connects the king of the first suit in the second area to the ace of the first suit in the fourth area;

wherein the sixth connector that connects the two of the first suit in the fourth area to the four of the first suit in the first area; and wherein the seventh connector that connects the three of the first suit in the fourth area to the nine of the first suit in the third area.

20. The computer implemented method of claim 17 further comprising:

after receiving the swap request, determining, with the processor, if information sent in the swap request corresponds to that the selected board playing card is adjacent to at least one of the requesting player's controlled cards and is adjacent to at least one of the opposing player's controlled cards;

transmitting, with the processor, to at least one of the requesting player computing device and opposing player computing device, information corresponding to 1) displaying the selected holding card wherein the selected board playing card was positioned on the gameboard before the swap request was received and 2) adding the selected board playing card to the requesting player's holding cards if the processor determines that information sent in the request that corresponds to the selected board playing card is also adjacent to at least one of the requesting player's controlled cards;

transmitting, with the processor, to at least one of the requesting player computing device and opposing player computing device, information corresponding to having displayed both the first battle card randomly selected from the requesting player's holding cards and the second battle card randomly selected from the opposing player's holding cards if the processor determines that information sent in the swap request that corresponds to that the selected board playing card is one of the opposing player's controlled cards;

wherein the gameboard further comprises a. a graphical representation of at least one connector, wherein at least one connector connects a first board playing card in a first playing area of the gameboard with a second board playing card in a second playing area of the gameboard, and wherein the method is configured such that if the first playing card and second playing card are connected by the connecter, then the first playing card and the second playing card are adjacent;

b. wherein the four playing cards in the first area are a four of spades adjacent and to the left of a five of spades, a six of spades adjacent and below the four and five of spades, and a seven of spades adjacent and below the six of spades;

c. wherein the two playing cards in the second area are a queen of spades adjacent and to the left of the king of spades, wherein the queen of spades is connected by a first connector to the five of spades;

d. wherein the three playing cards in the third area are an eight of spades adjacent and to the left of a nine of spades and a ten of spades adjacent and below the nine of spades, wherein the eight of spades is connected by a second connecter to the queen of spades and by a third connector to the seven of spades, and wherein the nine of spades is connected by a fourth connector to the king of spades;

e. wherein the four playing cards in the fourth area are an ace of spades adjacent and to the left of a two of spades, a three of spades below and adjacent to the ace of spades, a jack of spades below the two of spades and adjacent to both the three of spades and the two of spades;

f. wherein a fifth connector connects the king of spades with the ace of spades, a sixth connector connects the two of spades and the four of spades, and a seventh connector connects the three of spades and the nine of spades; and, g. wherein the one playing card in the fifth area is a joker adjacent to the jack of spades.

* * * * *